US005840470A

United States Patent [19]

Bohan et al.

[11] Patent Number: 5,840,470

[45] Date of Patent: Nov. 24, 1998

[54] RAPID IMAGE PRESENTATION METHOD EMPLOYING SILVER BROMIDE TABULAR GRAIN PHOTOGRAPHIC ELEMENTS

[75] Inventors: Anne E. Bohan; John M. Buchanan; Richard P. Szajewski, all of Rochester, N.Y.

[73] Assignee: Eastman Kodak Company, Rochester, N.Y.

[21] Appl. No.: 888,403

[22] Filed: Jul. 7, 1997

Related U.S. Application Data

[62] Division of Ser. No. 730,557, Oct. 15, 1996, Pat. No. 5,698,379.

[51] Int. Cl.[6] ..... G03C 7/407

[52] U.S. Cl. ..... 430/359; 430/362; 430/383; 430/489; 430/963; 358/518; 358/519; 358/520; 358/521

[58] Field of Search ..... 430/359, 362, 430/489, 963, 383, 567; 358/518, 519, 520, 521, 522, 523, 527

[56] References Cited

U.S. PATENT DOCUMENTS

| | | | |
|---|---|---|---|
| 4,063,951 | 12/1977 | Bogg | 430/567 |
| 4,399,215 | 8/1983 | Wey | 430/567 |
| 4,439,520 | 3/1984 | Kofron et al. | 430/434 |
| 4,500,919 | 2/1985 | Schreiber | 358/78 |
| 5,153,110 | 10/1992 | Kawai | 430/383 |
| 5,267,030 | 11/1993 | Giorgianni et al. | 358/527 |
| 5,320,938 | 6/1994 | House et al. | 430/567 |
| 5,344,750 | 9/1994 | Fujimoto et al. | 430/434 |
| 5,356,764 | 10/1994 | Szajewski et al. | 430/505 |
| 5,375,000 | 12/1994 | Ray | 358/506 |
| 5,376,508 | 12/1994 | Yamada et al. | 430/383 |
| 5,443,943 | 8/1995 | Szajewski et al. | 430/393 |
| 5,451,490 | 9/1995 | Budz et al. | 430/363 |
| 5,455,146 | 10/1995 | Nishikawa et al. | 430/383 |
| 5,457,007 | 10/1995 | Asami | 430/363 |
| 5,500,316 | 3/1996 | Bogdanowicz et al. | 430/383 |
| 5,574,659 | 11/1996 | Delvers et al. | 430/383 |
| 5,576,128 | 11/1996 | Keech et al. | 430/383 |
| 5,674,665 | 10/1997 | Sawyer et al. | 430/383 |

FOREIGN PATENT DOCUMENTS

| | | | |
|---|---|---|---|
| 0 624 028 A1 | 5/1993 | European Pat. Off. | H04N 1/46 |
| 4233228 | 10/1992 | Germany | H04N 1/00 |

*Primary Examiner*—Hoa Van Le
*Attorney, Agent, or Firm*—J. Lanny Tucker

[57] ABSTRACT

Silver bromide color negative films can be rapidly processed using shortened color development times and specific amounts of color developing agent and bromide ion. After development, and optionally desilvering or fixing, the developed film is scanned to form density representative digital signals for the color records. These signals are then digitally manipulated to correct both interimage interactions and gamma mismatches around the color records to produce a digital record that is capable of providing a display image having desired aim color and tone scale reproduction. That digital record can then be stored or used to provide corrected display images, such as color prints, using output display devices.

14 Claims, 3 Drawing Sheets

RAPID IMAGE PRESENTATION METHOD EMPLOYING SILVER BROMIDE TABULAR GRAIN PHOTOGRAPHIC ELEMENTS

This is a Divisional of application Ser. No. 08/730,557, filed Oct. 15, 1996, U.S. Pat. No. 5,698,379.

FIELD OF THE INVENTION

This invention relates to a rapid image presentation method employing light sensitive silver chloride tabular grain containing photographic materials. In particular, it relates to a method for rapid chemical processing of such an imagewise exposed light sensitive material followed by digitizing and color optimizing the digitized image.

BACKGROUND OF THE INVENTION

Production of photographic color images from light sensitive materials basically consists of two processes. First, color negative images are generated by light exposure of camera speed light sensitive films, that are sometimes called "originating" elements because the images are originated therein by the film user (that is, "picture taker"). These negative images are then used to generate positive images in light sensitive materials. These latter materials are sometimes known as "display" elements and the resulting images may be known as "prints" when coated on reflective supports or "films" when coated on nonreflective supports.

The light sensitive materials are processed in automated processing machines through several steps and processing solutions to provide the necessary display images. Traditionally, this service has required a day or more to provide the customer with the desired prints. In recent years, customers have wanted faster service, and in some locations, the time to deliver this service has been reduced to within an hour. Reducing the processing time to within a few minutes is the ultimate desire in the industry. To do this, each step of the process must be shortened.

Reduction in processing time of the "display" elements or color photographic papers has been facilitated by a number of recent innovations, including the use of predominantly silver chloride emulsions in the elements, and various modifications in the processing solutions and conditions so that each processing step is shortened. In some processes, the total time can be reduced to less than two minutes, and even less than 90 seconds.

Most color negative films generally comprise little or no silver chloride in their emulsions, and have silver bromide as the predominant silver halide. More typically, the emulsions are silver bromoiodide emulsions having up to several mol percent of silver iodide. Emulsions containing high silver chloride have generally had insufficient light sensitivity to be used as camera speed materials although they have the advantage of being rapidly processed without major changes to the color developer solution.

However, considerable effort continues to develop and provide camera speed light sensitive photographic films that contain predominantly silver chloride emulsions. See, e.g. U.S. Pat. No. 4,439,520 (Kofron et al), U.S. Pat. No. 5,320,938 (House et al), U.S. Pat. No. 5,356,764 (Szajewski et al) and U.S. Pat. No. 5,451,490 (Budz et al).

To shorten the processing time, specifically the color development time, of films containing either silver bromoiodide or silver chloride emulsions, more active color developer solutions are needed. Various attempts have been made to increase color developer activity by increasing the pH, increasing the color developing agent concentration, decreasing the halide ion concentration, or increasing temperature. However, when these changes are made, the stability of the solution and the photographic image quality are often diminished.

For example, when the color development temperature is increased from the conventional 37.8° C., and the color developer solution is held (or used) in the processing tanks for extended periods of times, elements processed with such solutions often exhibit unacceptably high density in the unexposed areas of the elements, that is unacceptably high Dmin.

Stabilizing processing solutions for extended periods of time at high temperature in rapid color development of silver bromoiodide films has been accomplished by the use of a specific hydroxylamine antioxidant, as described in copending and commonly assigned U.S. Ser. No. 08/590,241 (filed Jan. 23, 1996, by Cole).

Various methods have been proposed for overcoming problems encountered in processing high chloride silver halide elements. For example, novel antioxidants have been developed to stabilize developer solutions (e.g., U.S. Pat. No. 4,897,339 of Andoh et al, U.S. Pat. No 4,906,554 of Ishikawa et al, and U.S. Pat. No. 5,094,937 of Morimoto). High silver chloride emulsions have been doped with iridium compounds, as described in EP-A-0 488 737. Dyes have been developed to eliminate dye remnants from rapid processing as described in U.S. Pat. No. 5,153,112 (Yoshida et al). Novel color developing agents have been proposed for rapid development as described in U.S. Pat. No. 5,278,034 (Ohki et al).

All of the foregoing methods have been designed for processing high silver chloride photographic papers, and are not completely effective in processing color negative silver chloride films.

U.S. Pat. No. 5,344,750 (Fujimoto et al) describes a method for processing elements containing silver iodobromide emulsions that is allegedly rapid, including color development for 40–90 seconds. The potential problems of low sensitivity and high fog in rapidly developed elements is asserted to be overcome by using a color development temperature and an amount of color developing agent and bromide ion in the color developer that are determined by certain mathematical relationships. This approach would not be useful for processing high silver chloride films because these films show unacceptably high fog and granularity under the proposed color development conditions. Furthermore, the conditions described for color development of silver bromoiodide films produce less than optimal sensitivity when used for developing silver chloroiodide films.

Similarly, U.S. Pat. No. 5,455,146 (Nishikawa et al) describes a method for forming color images in photographic elements containing silver iodobromide emulsions that is allegedly rapid and includes color development for 30–90 seconds. The potential problems of gamma imbalance are asserted to be overcome by controlling the morphology of the light sensitive silver halide emulsion grains, the thickness and swell rate of the photographic film, and the ratio of 2-equivalent color couplers to total couplers in the red-sensitive silver halide emulsion layer. However, the methods described in this patent require a color negative film to be specifically constructed with the noted features to correct gamma imbalance, but they do not correct the color imbalance produced by rapidly developing commercially available color negative films that do not have the noted features. In other words, the method of gamma correction requires a specific film and cannot be applied to just any film on the market. Moreover, there is no teaching in this reference about how silver chloride films can be processed in a rapid manner.

After a color negative film has been chemically processed in the manner described above, it can be scanned to create a digital representation of the image. The most common approach to scanning an image is to record the transmission of a light beam, point-by-point or line-by-line. In color photography, blue, green and red scanning beams are modulated by the yellow, magenta and cyan image dyes, respectively. In a variant color scanning approach the blue, green and red scanning beams are combined into a single white scanning beam modulated by the image dyes that is read through blue, green and red filters to create separate color records. These records can then be read into any convenient memory medium (for example, an optical disk). Systems in which the image is passed through an intermediate device, such as a scanner or computer, are often referred to as "hybrid" imaging systems.

A hybrid imaging system must include a method for scanning or otherwise measuring the individual picture elements of the photographic media, which serve as input to the system, to produce image-bearing signals. In addition, the system must provide a means for transforming the image-bearing signals into an image representation or encoding that is appropriate for the particular uses of the system.

Hybrid imaging systems have numerous advantages because they are free of many of the classical constraints of photographic embodiments. For example, systematic manipulation (for example, image reversal, and hue and tone alteration) of the image information, that would be cumbersome or impossible to accomplish in a controlled manner in a photographic element, is readily achieved. The stored information can be retrieved from memory to modulate light exposures necessary to recreate the image as a photographic negative, slide or print at will. Alternatively, the image can be viewed on a video display or printed by a variety of techniques beyond the bounds of classical photography, such as electrophotography, ink jet printing, dye diffusion printing and other techniques known in the art.

U.S. Pat. No. 4,500,919 (Schreiber) describes an image reproduction system in which an electronic reader scans an original color image and converts it to electronic image-bearing signals. A computer workstation and an interactive operator interface, including a video monitor, permit an operator to edit or alter the image-bearing signals by means of displaying the image on the monitor. The workstation causes the output device to produce an inked output corresponding to the displayed image. The image representation or encoding is meant to represent the colorimetry of the image being scanned. Calibration procedures are described for transforming the image-bearing signals to an image representation or encoding so as to reproduce the colorimetry of a scanned image on the monitor and to subsequently reproduce the colorimetry of the monitor image on the inked output.

However, representation of the image recorded by the film is not necessarily the desired final image. U.S. Pat. No. 5,375,000 (Ray et al) teaches that the scanned image can be modified with a function representing the inverse of the film characteristic curve [density vs. log(exposure)] to obtain a representation of the image more closely representing the original image log(exposure). This approach could be used to restore the mismatched gammas in the negative film caused by rapid processing. However, modern color negative films are also designed to have chemical interactions (interimage) between the different color records to achieve a desired color position, and not necessarily a perfect rendition of the original scene. These interactions are dependent upon processing time and will produce color errors in a rapidly processed film. These changes in interimage cannot be corrected using conventional color correction tools but can be corrected when the image information has been transformed into a digital representation of the image density.

EP-A-0 624 028 (Giorgianni et al) describes an imaging system in which image-bearing signals are converted to a different form of image representation or encoding, representing the corresponding colorimetric values that would be required to match, in the viewing conditions of a uniquely defined reference viewing environment, the appearance of the rendered input image as that image would appear, if viewed in a specific input viewing environment. The described system allows for input from disparate types of imaging media, such as photographic negatives as well as transmission and reflection positives. The image representation or encoding of that system is meant to represent the color appearance of the image being scanned (or the rendered color appearance computed from a negative being scanned), and calibration procedures are described so as to reproduce that appearance on the monitor and on the final output device or medium.

U.S. Pat. No. 5,267,030 (Giorgianni et al) describes a method for deriving, from a scanned image, recorded color information that is substantially free of color alterations produced by the color reproduction properties of the imaging element. In this reference, the described system computationally removes the effects of media-specific signal processing as far as possible, from each input element used by the system. In addition, the chromatic interdependencies introduced by the secondary absorptions of the image-forming dyes, as measured by the responsivities of the scanning device, are also computationally removed. Use of the methods described in this reference transforms the signals measured from the imaging element to the exposures recorded from the original image.

Copending and cofiled U.S. Ser. No. 08/729,937 filed on even date herewith by Bohan and Cole, and entitled "Rapid Processing of Silver Bromoiodide Color Negative Films and Digital Image Correction To Provide Display Images Having Desired Aim Color and Tone Scale Reproduction" describes and claims a method for correcting color images in silver bromoiodide films. However, since silver chloride and silver bromoiodide films are not necessarily interchangeable and processing conditions must be carefully tailored for each type of emulsion, the methods described therein are not necessarily useful for processing high silver chloride films.

There remains a need for a process for providing color display images from images originated in high silver chloride films and correcting color imbalances that occur in the color records from the rapidity of the film processing. In particular, there is a need for even more improved processing time and conditions, and resulting color image correction, with high silver chloride films compared to silver bromoiodide films.

SUMMARY OF THE INVENTION

The problems noted above are overcome with a method for providing a color display image comprising the steps of:

A) color developing an imagewise exposed silver halide film having at least two color records, each color record having at least one silver halide emulsion comprising silver halide grains comprising at least 50 mol % silver chloride, the film exhibiting a photographic sensitivity of at least ISO 25, with a color developer having a pH of from about 9 to about 12, and comprising:

a color developing agent at from about 0.01 to about 0.1 mol/l, and bromide ion at from about 0.003 to about 0.1 mol/l, the color developing being carried out for up to about 90 seconds at a temperature at or above about 35° C., B) scanning the developed film to form density representative digital signals for the at least two color records, and C) digitally manipulating the density representative digital signals formed in step B to correct either or both interimage interactions and gamma mismatches among the at least two color records so as to produce a digital record of the corrected color image.

The method of this invention properly corrects for the color imbalance when color negative silver chloride films are rapidly processed under certain color development conditions. Such errors in the color records are not correctable using conventional color printing techniques. However, it has been discovered that the errors can be corrected using:

multi-variable designed experiments to optimize the developer solution composition for short development time, scanning processed silver chloride film to form density representative digital signals of the photographic images, calculating color correction factors from the density representative digital signals corresponding to the specific exposures, utilizing the calculated color correction values and the density representative digital signals corresponding to the photographic images to form corrected density representative digital signals, and utilizing the corrected density representative digital signals to produce display images having desired color and tone scale reproduction.

It has also been observed that even greater processing improvements are achieved with the present invention than are achieved with silver bromoiodide elements as described in copending U.S. Ser. No. 08/729,937 of Bohan and Cole (noted above).

In another embodiment of this invention, the problems noted above with conventional methods are overcome with a method for providing a color display image comprising the steps of:

A) color developing an imagewise exposed silver halide film having a support that is substantially transparent after processing, and having thereon a coated layer thickness of up to about 24 $\mu$m and at least two color records, each color having at least one silver halide emulsion, the film exhibiting a photographic sensitivity of at least ISO 25, the film further comprising up to about 0.1 mmol/m$^2$ of an incorporated permanent Dmin adjusting dye, and up to about 0.2 mmol/m$^2$ of a color masking coupler, with a color developer having a pH of from about 9 to about 12, and comprising:

a color developing agent at from about 0.01 to about 0.1 mol/l, and bromide ion at from about 0.003 to about 0.1 mol/l, the color developing being carried out at a temperature of at least 35° C., B) scanning the developed film to form density representative digital signals for the at least two color records, and C) digitally manipulating the density representative signals formed in step B to correct either or both interimage and gamma mismatches among the at least two color records so as to produce a digital record of the corrected color image.

It has been observed that both improved process speed and improved color reproduction are achieved with the method just described wherein the film contains only limited amounts of a color masking coupler.

DETAILED DESCRIPTION OF THE INVENTION

Figure 1:
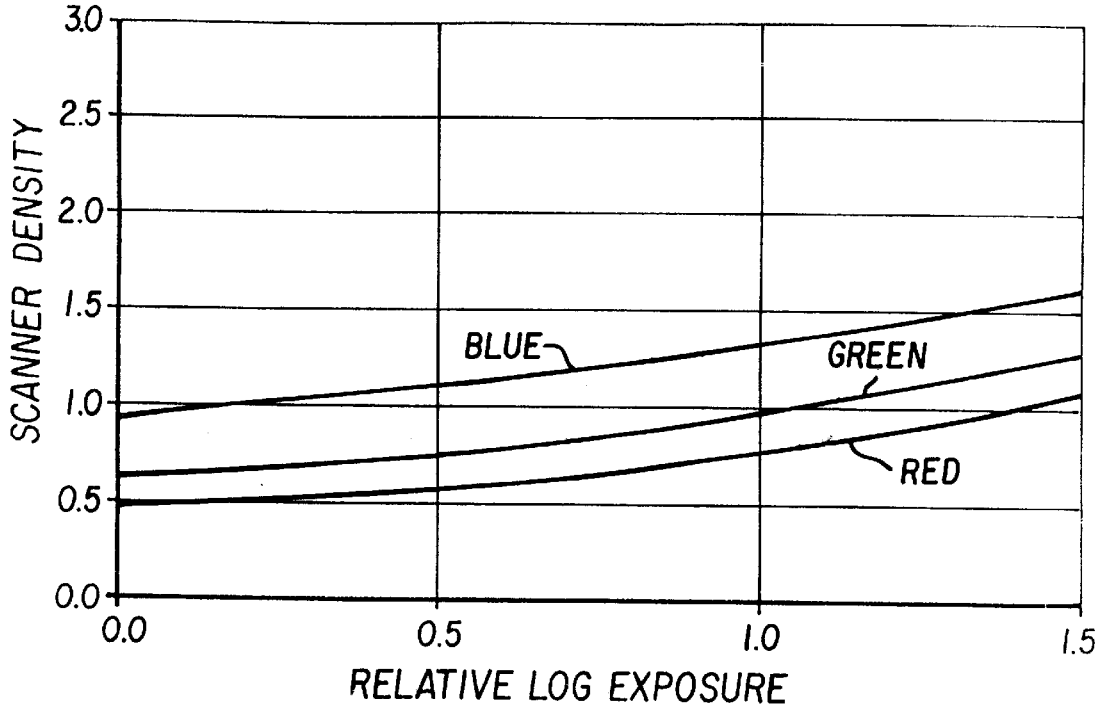
FIG. 1 shows the scanner density representative signals as a function of log Exposure for Film Sample 1 developed according to Rapid Process B as explained in the Comparison Imaging Example below.

In a preferred embodiment, the present invention is particularly useful for processing camera speed negative photographic films containing predominantly silver chloride emulsions (at least 50 mol % silver chloride). Preferably, the emulsions contain at least 70 mol % silver chloride, and more preferably, at least 90 mol % silver chloride.

Generally, the iodide ion content of such preferred silver halide emulsions is less than about 5 mol % (based on total silver), preferably from about 0.1 to about 2 mol %, and more preferably, from about 0.3 to about 1 mol %. Substantially the remainder of the silver halide is silver chloride.

In a second embodiment of this invention, when the quantities of incorporated color masking couplers and incorporated Dmin adjusting dyes are purposely limited (as described in detail below), the films processed according to this invention can have different halide compositions. For example, the emulsions can be predominantly silver bromide (at least about 50 mol %), with the remainder being silver chloride and silver iodide. Useful image to fog discrimination can be achieved with such films at limited color development times because the extraneous density provided by the masking couplers and Dmin adjusting dyes is purposely minimized.

The emulsions can be of any regular crystal morphology (such as cubic, octahedral, cubooctahedral or tabular as are known in the art) or mixtures thereof, or irregular morphology (such as multiple twinning or rounded). The size of tabular grains, expressed as an equivalent circular diameter, is determined by the required speed for the applied use, but is preferably from about 0.06 to about 10 μm, and more preferably, from about 0.1 to about 5 μm.

The silver chloride emulsions particularly useful in the practice of this invention can comprise tabular silver halide grains that are bounded by either {100} or {111} major faces having adjacent edge ratios of less than 10 and having an average aspect ratio of at least 2 and generally less than about 100. Generally, at least 50 mol % of the total silver halide is silver chloride in such emulsions. Further details of such {100} emulsions are provided, for example, in U.S. Pat. No. 5,443,943 (Szajewski et al), U.S. Pat. No. 5,320,938 (House et al), U.S. Pat. No. 5,395,746 (Brust et al), U.S. Pat. No. 5,314,798 (Brust et al) and U.S. Pat. No. 5,413,904 (Chang et al), all incorporated herein by reference.

The {111} high silver chloride tabular emulsions useful in the practice of this invention comprise a chemically and spectrally sensitized tabular silver halide emulsion population comprised of at least 50 mol percent chloride, based on silver, wherein at least 50 percent of the grain population projected area is accounted for by tabular grains bounded by {111} major faces, each having an aspect ratio of at least 2 and each being comprised of a core and a surrounding band (or shell) containing a higher level of bromide or iodide ion than is present in the core, the band containing up to about 30 percent of the silver in the tabular grain.

These grains have well defined exterior crystal faces that lie in {111} crystallographic planes which are substantially parallel and the overall grain shape is tabular. Tabular grains are preferred in the practice of this invention since they provide improved sensitivity relative to the related {111} octahedral shaped or other {111} grains also known in the art.

While both {100} and {111} high silver chloride tabular grains are useful in the practice of this invention, the {100} grains are preferred because of their more facile preparation and sensitization, and because of their often superior speed-grain performance.

The tabular grains generally have a thickness of 0.5 μm or less, and preferably have a thickness of less than about 0.3 μm. Ultra-thin grains limited in thickness only by having a thickness of greater than about 0.01 μm are specifically contemplated. The grains will generally have a diameter of less than about 10 μm and preferably have a diameter of less than about 7 μm. Generally, grain diameters of greater than about 0.2 μm are useful while diameters of greater than about 0.4 μm are preferred. The grains must have an aspect ratio of greater than about 2 and preferably have an aspect ratio greater than about 8, and less than about 100.

Tabular grains can also be defined by their Tabularity which is the ratio of the diameter to the square of the grain thickness. The tabular grain emulsions useful in the practice of this invention will generally have a Tabularity greater than about 5 and preferably greater than about 25. The Tabularity will generally be less than about 15,000, preferably less than about 5,000 and most preferably less than about 1,000.

The grain shape criteria described above can be readily ascertained by procedures well known to those skilled in the art. For example, it is possible to determine the diameter and thickness of individual grains from shadowed electron micrographs of emulsion samples. The diameter of a tabular grain refers to the diameter of a circle equal in area to the projected area of that tabular grain. This diameter is often described colloquially as an equivalent circular diameter (ECD). Generally a tabular grain has two parallel faces and the thickness of the grain refers to the distance between the two parallel faces. The halide content of individual grains can be determined by well known microprobe techniques while the halide content of an emulsion population generally follows from the details of precipitation and sensitization and can be verified by microprobe, atomic absorption or x-ray fluorescence techniques. From these measurements, the proportion of grains in an emulsion sample fulfilling the requirements of this invention can be determined. The average equivalent circular diameter of the grains in an emulsion sample is the average of the individual equivalent circular diameters of the grains in that sample. In the same manner, the average grain thickness is the average of the grain thickness of the individual grains, the average aspect ratio is the average of the individual aspect ratios and the average Tabularity is the average of the individual Tabularities. Such electron micrographs of {111} tabular emulsions when viewed face-on generally have the appearance of hexagons or tip-truncated hexagons of greater or lesser regularity while electron micrographs of {100} tabular emulsions have the appearance of squares or rectangles of greater or lesser regularity. It is preferred that the coefficient-of-variation in the ECD or thickness of the grains in a useful emulsion population be less than about 60% and preferably less than about 30% as this provides improved tone scale, image granularity behavior and other properties as described in the art.

In the context of this invention, a band refers both to a localized surface layer of silver halide deposited in a continuous fashion on a preformed silver halide grain core. When the band is deposited in a continuous fashion, it may fully enclose the core region or alternatively, it may encircle the core region forming a continuous ring-like deposit localized along the grain edges, or again alternatively it may form a continuous deposit on the grain faces. A core refers to the pre-formed silver halide grain onto which the band is formed. The halide composition of the band and core regions of the grain are of different compositions as dictated by the halide composition of the solutions used in the precipitation. The band is formed after at least 50 percent, but preferably 70 percent or more preferably 90 percent, of the grain formation reaction or grain precipitation, is completed. When the higher silver bromide or silver iodide band is formed before all of the silver salt solution has been added, it may be followed by a region of lower silver bromide or silver iodide proportion. Alternatively, the band may be formed after all of the silver salt solution has been added by the addition of a second salt solution wherein the solubility with silver ion of the second halide is sufficiently less than that of the first silver halide so that conversion of the surface silver halide layer will result. The grains may contain multiple bands around a central core and the bands may vary in the proportion of chloride, bromide and iodide. While the band may contain up to about 30 percent of the silver in the tabular grain, it is preferred that the band contain between about 0.1 and 10 percent of the silver in the tabular grain, and even more preferred that the band contain between about 0.2 and 3 percent of the silver in the tabular grain.

The high chloride tabular grains with the bromide or iodide band useful in the practice of this invention can be prepared by precipitation procedures known in the art, or by obvious modifications of such procedures.

While either bromide or iodide can be used to stabilize the grain surface, the use of iodide for this function is preferred since the iodide band provides superior morphological stability to the otherwise unstable {111} grains. In the case of both the {100} and {111} grains, the iodide band or shell can additionally provide improved photoefficiency. Additionally, bromide and or iodide may be incorporated in the emulsion in any manner known in the art. In particular, iodide may advantageously be present or added during emulsion grain preparation, particularly during the grain nucleation and grain growth steps, and during grain sensitization. When bromide or iodide, or both are added during a grain growth step or for the purposes of band formation they may be added continuously as a halide run or may be added at discrete times as a halide dump. The halide may be supplied as soluble halide ion, as a sparingly soluble salt or by release from an organic carrier during an emulsion preparation step. Total emulsion iodide content should be less than about 5 mol percent, preferably less than about 2 mol percent and most preferably less than about 1 mol percent iodide, based on silver, to ensure good development and desilvering characteristics. The remainder of the emulsion halide may be bromide which can be incorporated as described or in any manner known in the art. The emulsion may be chemically sensitized, doped or treated with various metals and sensitizers as known in the art, including iron, sulfur, selenium, iridium, gold, platinum or palladium so as to modify or improve its properties. The emulsions can also be reduction sensitized during the preparation of the grains by using thiourea dioxide and thiosulfonic acid according to the procedures in U.S. Pat. No. 5,061,614. The grains may be spectrally sensitized as known in the art.

Preferably, the elements have at least two separate light sensitive emulsion layers, at least one being in each of two different color records. More preferably, there are three color records, each having at least one silver chloride emulsion as described herein.

Such elements generally have a camera speed defined as an ISO speed of at least 25, preferably an ISO speed of at least 50, and most preferably an ISO speed of at least 100.

The speed or sensitivity of color negative photographic materials is inversely related to the exposure required to enable the attainment of a specified density above fog after processing. Photographic speed for color negative films with a gamma of about 0.65 has been specifically defined by the American National Standards Institute (ANSI) as ANSI Standard Number PH 2.27–1979 (ASA speed) and relates to the exposure levels required to enable a density of 0.15 above fog in the green light sensitive and least sensitive recording unit of a multicolor negative film. This definition conforms to the International Standards Organization (ISO) film speed rating. For the purpose of this invention, if the film gamma is substantially different from 0.65, the ISO speed is calculated by linearly amplifying or deamplifying the gamma vs. log E (exposure) curve to a value of 0.65 before determining the sensitivity.

The layers of the photographic elements can have any useful binder material or vehicle known in the art, including various types of gelatins and other colloidal materials (or mixtures thereof). One useful binder material is acid processed gelatin that can be present in any layer in any suitable amount.

The photographic elements processed in the practice of this invention are multilayer color elements having at least two color records. Multilayer color elements typically contain dye image-forming units (or color records) sensitive to each of the three primary regions of the visible spectrum. Each unit can be comprised of a single emulsion layer or multiple emulsion layers sensitive to a given region of the spectrum. The layers of the element can be arranged in any of the various orders known in the art. In an alternative format, the emulsions sensitive to each of the three primary regions of the spectrum can be disposed as a single segmented layer. The elements can also contain other conventional layers such as filter layers, interlayers, subbing layers, overcoats and other layers readily apparent to one skilled in the art. A magnetic backing can be used as well as conventional supports.

The total thickness of the coated layers in the films used in this invention should be up to about 30 $\mu$m, and preferably less than or equal to about 24 $\mu$m, and most preferably less than or equal to about 18 $\mu$m, so as to improve image sharpness and promote access of processing chemicals to the coated emulsion layers. Further, the coated layers should swell during processing. The extent of swell can be quantified as the ratio of wet thickness to dry thickness of the coated layers. Swell ratios of between about 1.2 and about 6 are contemplated in this invention, while swell ratios of between about 1.9 and 3.0 are preferred. Smaller degrees of swell generally correspond to higher tortuosity and greater difficulty for processing solutions to enter and leave the coated layers. Larger degrees of swell can result in poor physical integrity of the coated layers. Thickness and swell can be measured by microscopic examination of cross-sections of the films, or by direct measurement of film sample thickness, using conventional procedures.

In a preferred embodiment, the supports of the films useful in this invention are substantially transparent after photographic processing and before digital scanning. Suitable materials for such supports are well known and generally include well known transparent polymeric materials such as polyesters, polycarbonates, polystyrenes, cellulose acetates, cellulose nitrate, and other materials two numerous to mention. Preferred support materials include, but are not limited to polyesters such as poly(ethylene terephthalate) and poly(ethylene naphthalate). By "substantially transparent" is meant that the support will have an optical color density of less than about 0.1 to red, green or blue light in the 450 to 650 nm range. More preferably, the supports have an optical density after processing of less than about 0.05 on average, to red, green and blue light. This limited density improves the subsequent scanning and digitization of the imagewise exposed and processed film. Such supports are generally transparent at all times, but in some cases, supports can be used that are opaque or reflective before processing and substantially transparent after color processing.

Considerable details of element structure and components, and suitable methods of processing various types of elements are described in *Research Disclosure*, noted below. Included within such teachings in the art is the use of various classes of cyan, yellow and magenta color couplers that can be used with the present invention. In particular, the present invention can be used to process photographic elements containing pyrazolotriazole magenta dye forming couplers.

In a preferred embodiment of this invention, the processed photographic film contains only limited amounts of color masking couplers and incorporated permanent Dmin adjusting dyes. Generally, such films contain color masking couplers in total amounts up to about 0.6 mmol/m$^2$, preferably in amounts up to about 0.2 mmol/m$^2$, more preferably in amounts up to about 0.05 mmol/m$^2$, and most preferably in amounts up to about 0.01 mmol/m$^2$.

The incorporated permanent Dmin adjusting dyes are generally present in total amounts up to about 0.2 mmol/m$^2$, preferably in amounts up to about 0.1 mmol/m$^2$, more preferably in amounts up to about 0.02 mmol/m$^2$, and most preferably in amounts up to about 0.005 mmol/m$^2$.

Limiting the amount of color masking couplers and incorporated permanent Dmin adjusting dyes serves to reduce the optical density of the films, after processing, in the 450 to 650 nm range, and thus improves the subsequent scanning and digitization of the imagewise exposed and processed films.

Overall, the limited Dmin and tone scale density enabled by controlling the quantity of incorporated color masking couplers, incorporated permanent Dmin adjusting dyes and support optical density can serve to both limit scanning noise (which increases at high optical densities), and to improve the overall signal-to-noise characteristics of the film to be scanned. Relying on the digital correction step to provide color correction obviates the need for color masking couplers in the films. When the density sources are thusly controlled, the silver halide emulsions in the films need not be predominantly silver chloride emulsion, but can then be predominantly silver bromide emulsions, as described above. However, if processing time is to be shortened, the best emulsions are predominantly silver chloride emulsions as described above, with or without color masking couplers.

In a preferred embodiment, the films useful in this invention have three color records, including a red light-sensitive color record having a peak spectral sensitivity between about 580 and 700 nm, a green light-sensitive color record having a peak spectral sensitivity between about 500 and 600 nm, and a blue light-sensitive color record having a peak spectral sensitivity between about 400 and 500 nm. While any combination of spectral sensitivities can be used in the films used in the practice of this invention, the spectral sensitivities of copending and commonly assigned, recently allowed U.S. Ser. Nos. 08/469,062 (now U.S. Pat. No. 5,582,961) and 08/466,862 (now U.S. Pat. No. 5,609,978), both filed Jun. 6, 1995 by Giorgianni et al are particularly useful in this invention. Such spectral sensitivities include a peak sensitivity in the red color record of from 595 to 615 nm, a peak sensitivity in the green color record of from 530 to 545 nm and a peak sensitivity in the blue color record of from 440 to 455 nm.

Additional auxiliary color records with distinct spectral sensitivities as known in the art can also be present in the films. While the red, green and blue color records generally produce cyan, magenta and yellow dye images, respectively, other combinations of useful record sensitivity produced dye images are known and are specifically contemplated for use in the practice of this invention. In particular, the hues of the chromogenic dyes may be chosen to better match the spectral sensitivities of image scanning devices.

It is generally preferred that the dyes formed during the development step be well separated in hue and be spectrally broad in shape. The scanning and digitization steps are further enhanced by designing the color records to have an overall maximum density of less than about 2 so as to minimize scanner noise. Further, it is preferred that Density vs. log E curves of the imagewise exposed films be linear after processing so as to enable the use of exposure independent digital deconvolution of the scanned image. Digital deconvolution is further improved by providing color elements having exposure independent chemical and optical interimage effects.

In a preferred embodiment, the color originating film useful in this invention is a color negative film having an exposure latitude of at least about 1.5 log E, preferably having an exposure latitude of at least about 2 log E, more preferably having an exposure latitude of at least about 2.5 log E, and most preferably having an exposure latitude of at least about 3.0 log E. Exposure latitudes of up to about 6 to 10 log E are contemplated. As is well understood in the art, exposure latitude defines the useful range of exposure conditions which may be recorded on a light sensitive element. These preferred exposure latitudes enable improved scene recording under a wide variety of lighting conditions. Further, the dye color records will have gammas (i.e., slopes of Density vs. log E curves) of between about 0.1 and 1.0. The gammas will preferably be less than about 0.7, more preferably be less than about 0.5 and most preferably be between about 0.2 and 0.45. The utility of such gamma control is described in U.S. Pat. No. 5,500,315 (Bogdanowicz et al) and U.S. Ser. No. 08/246,598 (by Keech et al) filed 20 May 1994, the disclosures of which are both incorporated by reference.

Further details of such elements, their emulsions and other components are well known in the art, including *Research Disclosure*, publication 36544, pages 501–541 (September 1994). *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). This reference will be referred to herein as "*Research Disclosure*".

The films described herein are color developed using a color developer solution having a pH of from about 9 to about 12 (preferably from about 9.5 to about 11.0). The color developer solution pH can be adjusted with acid or base to the desired level, and the pH can be maintained using any suitable buffer having the appropriate acid dissociation constants, such as carbonates, phosphates, borates, tetraborates, phosphates, glycine salts, leucine salts, valine salts, proline salts, alanine salts, aminobutyric acid salts, lysine salts, guanine salts and hydroxybenzoates or any other buffer known in the art to be useful for this purpose.

The color developer also includes one or more suitable color developing agents, in an amount of from about 0.01 to about 0.1 mol/l, and preferably at from about 0.02 to about 0.07 mol/l. Any suitable color developing agent can be used, many of which are known in the art, including those described in *Research Disclosure*, noted above. Particularly useful color developing agents include but are not limited to, aminophenols, p-phenylenediamines (especially N,N-dialkyl-p-phenylenediamines) and others that are well known in the art, such as EP-A 0 434 097A1 (published Jun. 26, 1991) and EP-A 0 530 921A1 (published Mar. 10, 1993). It may be useful for the color developing agents to have one or more water-solubilizing groups.

Bromide ion may be included in the color developer in an amount of from about 0.003 to about 0.1 mol/l, and preferably from about 0.004 to about 0.05 mol/l. Bromide ion can be provided in any suitable salt such as sodium bromide, lithium bromide, potassium bromide, ammonium bromide, magnesium bromide, or calcium bromide.

Preferably, the color developer contains chloride ion from a suitable chloride salt at a concentration generally up to 0.5 mol/l, and preferably up to 0.2 mol/l. The color developer may also contain a small amount of iodide ion from a suitable iodide salt, such as lithium iodide, potassium iodide, sodium iodide, calcium iodide, ammonium iodide or magnesium iodide. The amount of iodide ion may be from 0 to about $1\times10^{-4}$ mol/l.

In addition to the color developing agent, bromide salts and buffers, the color developer can contain any of the other components commonly found in such solutions, including but not limited to, preservatives (also known as antioxidants), metal chelating agents (also known as metal sequestering agents), antifoggants, optical brighteners, wetting agents, stain reducing agents, surfactants, defoaming agents, auxiliary developers (such as those commonly used in black-and-white development), development accelerators, and water-soluble polymers (such as a sulfonated polystyrene).

Useful preservatives include, but are not limited to, hydroxylamines, hydroxylamine derivatives, hydroxamic acid, hydrazines, hydrazides, phenols, hydroxyketones, aminoketones, saccharides, sulfites, bisulfites, salicylic acids, alkanolamines, α-amino acids, polyethylineimines, and polyhydroxy compounds. Mixtures of preservatives can be used if desired. Hydroxylamine or hydroxylamine derivatives are preferred.

Antioxidants particularly useful in the practice are represented by the formula:

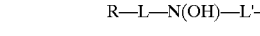

R—L—N(OH)—L'—R' wherein L and L' are independently substituted or unsubstituted alkylene of 1 to 8 carbon atoms (such as methylene, ethylene, n-propylene, isopropylene, n-butylene, 1,1-dimethylethylene, n-hexylene, n-octylene and sec-butylene), or substituted or unsubstituted alkylenephenylene of 1 to 3 carbon atoms in the alkylene portion (such as benzylene, dimethylenephenylene, and isopropylenephenylene).

The alkylene and alkylenephenylene groups can also be substituted with up to 4 substituents that do not interfere with the stabilizing effect of the molecule, or the solubility of the compound in the color developer solution. Such substituents must be compatible with the color developer components and must not negatively impact the photographic processing system. Such substituents include but are not limited to, alkyl of 1 to 6 carbon atoms, fluoroalkyl groups of 1 to 6 carbon atoms, alkoxy of 1 to 6 carbon atoms, phenyl, hydroxy, halo, phenoxy, alkylthio of 1 to 6 carbon atoms, acyl groups, cyano, or amino.

In the noted formula, R and R' are independently hydrogen, carboxy, sulfo, phosphono, carbonamido, sulfonamido, hydroxy, alkoxy (1 to 4 carbon atoms) or other acid groups, provided that at least one of R and R' is not hydrogen. Salts of the acid groups are considered equivalents in this invention. Thus, the free acid forms of the hydroxylamines can be used, as well as the organic or inorganic salts of the acids, such as the alkali metal, pyridinium, tetraethylammonium, tetramethylammonium and ammonium salts. The sodium and potassium salts are the preferred salts. In addition, readily hydrolyzable ester equivalents can also be used, such as the methyl and ethyl esters of the acids. When L or L' is alkylenephenylene, the carboxy, sulfo or phosphono group is preferably at the para position of the phenylene, but can be at other positions if desired. More than one carboxy, sulfo or phosphono group can be attached to the phenylene radical.

Preferably, one or both of R and R' are hydrogen, carboxy or sulfo, with hydrogen and sulfo (or salts or readily hydrolyzable esters thereof) being more preferred. Most preferably, R is hydrogen and R' is sulfo (or a salt thereof).

Preferably, L and L' are independently substituted or unsubstituted alkylene of 3 to 6 carbon atoms (such as n-propyl, isopropyl, n-butyl, sec-butyl, t-butyl, n-pentyl, 1-methylpentyl and 2-ethylbutyl), or substituted or unsubstituted alkylenephenylene having 1 or 2 carbon atoms in the alkylene portion (such as benzyl, and dimethylenephenyl).

More preferably, at least one, and optionally both, of L and L' is a substituted or unsubstituted alkylene group of 3 to 6 carbon atoms that is branched at the carbon atom directly attached (that is, covalently bonded) to the nitrogen atom of the hydroxylamine molecule. Such branched divalent groups include, but are not limited to, isopropylene, sec-butylene, t-butylene, sec-pentylene, t-pentylene, sec-hexylene and t-hexylene. Isopropylene is most preferred.

In one embodiment, L and L' are the same. In other and preferred embodiments, they are different. In the latter embodiment, L is more preferably a branched alkylene as described above, and L' is a linear alkylene of 1 to 6 carbon atoms (such as methylene, ethylene, n-propylene, n-butylene, n-pentylene and n-hexylene).

Representative hydroxylamine derivatives useful of the noted formula include, but are not limited to, N-isopropyl-N-(2-ethanesulfonic acid)hydroxylamine, N,N-bis(propionic acid)hydroxylamine, N,N-bis(2-ethanesulfonic acid)hydroxylamine, N-isopropyl-N-(n-propylsulfonic acid) hydroxylamine, N-2-ethanephosphonic acid-N-(propionic acid)hydroxylamine, N,N-bis-(2-ethanephosphonic acid) hydroxylamine, N-sec-butyl-N(2-ethanesulfonic acid) hydroxylamine, N,N-bis(sec-butylcarboxylic acid) hydroxylamine, N-methyl-N-(p-carboxylbenzyl) hydroxylamine, N-isopropyl-N-(p-carboxylbenzyl) hydroxylamine, N,N-bis(p-carboxylbenzyl) hydroxylamine, N-methyl-N-(p-carboxyl-m-methylbenzyl)hydroxylamine, N-isopropyl-N-(p-sulfobenzyl)hydroxylamine, N-ethyl-N-(p-phosphonobenzyl)hydroxylamine, N-isopropyl-N-(2-carboxymethylene-3-propionic acid)hydroxylamine, N-isopropyl-N-(2-carboxyethyl)hydroxylamine, N-isopropyl-N-(2,3-dihydroxypropyl)hydroxylamine, and alkali metal salts thereof.

The hydroxylamine derivatives described herein as useful antioxidants can be readily prepared using published procedures, such as those described in U.S. Pat. No. 3,287,125, U.S. Pat. No. 3,778,464, U.S. Pat. No. 5,110,985 and U.S. Pat. No. 5,262,563, all incorporated herein by reference for the synthetic methods. One general synthetic procedure for preparing sulfo-substituted hydroxylamine derivatives comprises reacting an N-alkylhydroxylamine with a vinylsulfonate in a suitable solvent (such as water, an alcohol, tetrahydrofuran or methyl ethyl ketone). For the alkali metal salts of vinylsulfonates, water is the best solvent. In cases where the hydroxylammonium salt is available, an equivalent of a base must be used to liberate the free N-alkylhydroxylamine.

The organic antioxidant described herein is included in the color developer composition useful in this invention in an amount of at least about 0.001 mol/l, and in a preferred amount of from about 0.001 to about 0.5 mol/l. A most preferred amount is from about 0.005 to about 0.5 mol/l. More than one organic antioxidant can be used in the same color developer composition if desired, but preferably, only one is used.

The elements are typically exposed to suitable radiation to form a latent image and then processed to form a visible dye image. Processing includes the step of color development in the presence of a color developing agent to reduce developable silver halide and to oxidize the color developing agent. Oxidized color developing agent in turn reacts with a color-forming coupler to yield a dye.

Optionally but preferably, partial or total removal of silver and/or silver halide is accomplished after color development using conventional bleaching and fixing solutions (i.e., partial or complete desilvering steps), or fixing only to yield both a dye and silver image. Alternatively, all of the silver and silver halide can be left in the color developed element. One or more conventional washing, rinsing or stabilizing steps can also be used, as is known in the art. These steps are typically carried out before scanning and digital manipulation of the density representative signals.

Development is carried out by contacting the element for up to about 90 seconds (preferably less than about 50 seconds, and more preferably from about 5 to about 35 seconds) at a temperature above about 35° C., and generally at from about 40° to about 65° C., and preferably at from about 40° to about 60° C. in suitable processing equipment, to produce the desired developed image.

When the quantity of color masking coupler or incorporated permanent Dmin adjusting dye, or quantities of both, are limited as described above, and a substantially transparent support is used in the film, longer development times can be used. Such longer processing times can be up to about 195 seconds, but are generally up to about 150 seconds, preferably up to about 120 seconds, more preferably up to about 90 seconds. Shorter times can be used also, as described above.

The overall processing time (from development to final rinse or wash) can be from about 50 seconds to about 4 minutes. Shorter overall processing times, that is, less than about 3 minutes, are desired for processing photographic color negative films according to this invention.

Processing according to the present invention can be carried out using conventional deep tanks holding processing solutions or automatic processing machines. Alternatively, it can be carried out using what is known in the art as "low volume thin tank" processing systems, or LVTT, which have either a rack and tank or automatic tray design. Such processing methods and equipment are described, for example, in U.S. Pat. No. 5,436,118 (Carli et al) and publications noted therein.

Processing of the films can also be carried out using the method and apparatus designed for processing a film in a cartridge, as described for example in U.S. Pat. No. 5,543,882 (Pagano et al).

The residual error in photographic responses of photographic films that are processed as described above, is corrected by transforming the photographic color negative image to density representative digital signals and applying correction values to those digital signals. The term "correction value" is taken to refer to a broad range of mathematical operations that include, but are not limited to, mathematical constants, matrices, linear and non-linear mathematical relationships, and single and multi-dimensional look-up-tables (LUT's).

The term "density representative digital signals" refers to the electronic record produced by scanning a photographic image point-by-point, line-by-line, or frame-by-frame, and measuring the transmission of light beams, that is blue, green and red scanning beams that are modulated by the yellow, magenta and cyan dyes in the film negative. In a variant color scanning approach, the blue, green and red scanning beams are combined into a single white scanning beam that is modulated by the dyes, and is read through red, green and blue filters to create three separate digital records. Scanning can be carried out using any conventional scanning device.

The records produced by image dye modulation can then be read into any convenient memory medium (for example, an optical disk) for future digital manipulation or used immediately to produce a corrected digital record capable of producing a display image having desired aim color and tone scale reproduction. The aim color and tone scale reproduction may differ for a given photographic film image or operator. The advantage of the invention is that whatever the "aim," it can be readily achieved using the present invention.

The corrected digital signals (that is, digital records) can be also forwarded to an output device to form the display image. The output device may take a number of forms such as a silver halide film or paper writer, thermal printer, electrophotographic printer, ink jet printer, CRT display, CD disc or other types of storage and output display devices.

In one embodiment of this invention, the density representative digital signals obtained from scanning the rapidly processed film ($R_{Ti}$, $G_{Ti}$, $B_{Ti}$) are compared with the density representative digital signals ($R_{oi}$, $G_{oi}$, $B_{oi}$) obtained from standard processing of the same film having identical exposures, and a correction factor is determined.

In its simplest form, the correction factor can be derived from two exposures that are selected to exceed the minimum exposure required to produce a density above Dmin and are less than the minimum exposure required to achieve Dmax. Preferably, these exposures are selected to be as different as possible while falling within the region that exhibits a linear density response to log exposure. Preferably, the exposures are also neutral. Based on the density representative digital signals obtained for the two exposures in both the rapidly processed film according to this invention, and the standard temperature and time processed film, a simple gamma correction factor may be obtained.

Equations 1–3 below are used to calculate the correction factor for the red, green and blue color records respectively:

$$\Delta\gamma_R = \frac{R_{Oi_H} - R_{Oi_L}}{R_{Ti_H} - R_{Ti_L}} \tag{1}$$

$$\Delta\gamma_G = \frac{G_{Oi_H} - G_{Oi_L}}{G_{Ti_H} - G_{Ti_L}} \tag{2}$$

$$\Delta\gamma_B = \frac{B_{Oi_H} - B_{Oi_L}}{B_{Ti_H} - B_{Ti_L}} \tag{3}$$

In the above equations the subscript H and L refer to the high and low exposure levels respectively. In this approach, the density representative digital signals for the rapidly processed negative ($R_{Ti}$, $G_{Ti}$, $B_{Ti}$) are multiplied by ($\Delta\gamma_R$,$\Delta\gamma_G$, $\Delta\gamma_B$) to obtain the corrected density representative signals ($R_{pi}$, $G_{pi}$, $B_{pi}$).

An improved correction factor can be obtained by comparing additional density representative digital signals over a broad range of exposures. Either a set of 3 one-dimensional look-up tables could be derived or, to achieve additional accuracy, a multidimensional look-up table could be used. In practice these approaches would use the density representative digital signal(s) ($R_{Ti}$, $G_{Ti}$, $B_{Ti}$) for each pixel of an image as an index into the look-up tables to find a new density representative signal(s) ($R_{pi}$, $G_{pi}$, $B_{pi}$) that would more closely match that set of density representative digital signals ($R_{oi}$, $G_{oi}$, $B_{oi}$) which would be achieved using a standard temperature, standard time processed negative.

Another variant of this approach would be to calculate the functional relationship between ($R_{Ti}$, $G_{Ti}$, $B_{Ti}$) and ($R_{oi}$, $G_{oi}$, $B_{oi}$) as $$f((R_{oi}, G_{oi}, B_{oi})) = g((R_{Ti}, G_{Ti}, B_{Ti}))$$

and to use this equation to calculate corrected density representative digital signals ($R_{pi}$, $G_{pi}$, $B_{pi}$) which more closely match that set of density representative digital signals ($R_{oi}$, $G_{oi}$, $B_{oi}$) which would be achieved by a standard temperature, standard time processed negative. Additional variations on this approach could include a matrix, derived by regressing the density representative digital signals achieved by the rapidly processed negative, ($R_{Ti}$, $G_{Ti}$, $B_{Ti}$) and the desired density representative digital signals obtained from a standard temperature, standard time processed film, ($R_{oi}$, $G_{oi}$, $B_{oi}$). The matrix could also be used in combination with a set of look-up tables. The corrected density representative digital signals ($R_{pi}$, $G_{pi}$, $B_{pi}$) achieved by these approaches could then be further manipulated and/or enhanced digitally, displayed on a monitor, transmitted to a hardcopy device, or stored for use at a later date.

In another embodiment of the invention, the density representative digital signals from a rapidly processed film ($R_{Ti}$, $G_{Ti}$, $B_{Ti}$) are obtained for a well manufactured, correctly stored and processed film exposed to a series of patches that differ in color and intensity, and are stepped in intensity over the exposure scale. These density representative digital signals are used in combination with the exposure information for the different patches to generate an interimage correction matrix ($MAT_{ii}$).

$$MAT_{ii} = \begin{vmatrix} a_{11} & a_{12} & a_{13} \\ a_{21} & a_{22} & a_{23} \\ a_{31} & a_{32} & a_{33} \end{vmatrix}$$

This matrix describes the interaction between the three color records where development in one color record can influence development in one or both of the other color records. These types of interactions are well known in the photographic art and are the result of both undesired chemical interactions during development and deliberate chemical and optical interactions designed to influence the overall color reproduction of the film. The inverse of this matrix $(MAT_{ii})^{-1}$, in combination with the density representative digital signal ($R_{Ti}$, $G_{Ti}$, $B_{Ti}$) of the rapidly processed film according to this invention, can be used to calculate a channel independent density representative digital signal ($R_{ci}$, $G_{ci}$, $B_{ci}$)(representative of those densities that would have been obtained for the particular exposure if there were no interactions between layers):

$$\begin{bmatrix} R_{Ci} \\ G_{Ci} \\ B_{Ci} \end{bmatrix} = MATii - 1 \begin{bmatrix} R_{Ti} \\ G_{Ti} \\ B_{Ti} \end{bmatrix}.$$

The red, green and blue channel independent density representative digital signals ($R_{ci}$, $G_{ci}$, $B_{ci}$) are then converted to log(exposure or E) representative digital signals ($R_{LE}$, $G_{LE}$, $B_{LE}$) by the use of three one dimensional look-up tables. The recorded image is then in a form that is independent of the chemical processing.

The log(exposure) representative signals can now be processed in a variety of ways. They can be processed so as to achieve the color density representative digital signals ($R_{oi}$, $G_{oi}$, $B_{oi}$) which would have been achieved by a well manufactured, correctly stored and processed film of the same photographic film type that has been given identical exposures and processed in a standard temperature, standard time process. Alternatively, those signals can be processed to achieve the density representative digital signals that would have been obtained for an alternative photographic film type that has been given the same exposures and processed through a standard temperature and standard time process. The methods for these corrections include, but are not limited to, mathematical constants, linear and non-linear mathematical relationships, and look-up tables (LUT's).

It is important to remember that while the images are in the digital form the image processing is not limited to the color and tone scale corrections described above. While the image is in this form, additional image manipulation may be used including, but not limited to, standard scene balance algorithms (to determine printing corrections based on the densities of one or more areas within the negative), sharpening via convolution or unsharp masking, red-eye reduction and grain-suppression. Moreover, the image may be artistically manipulated, zoomed, cropped, combined with additional images, or other manipulations known in the art. Once the image has been corrected and any additional image processing and manipulation has occurred, the image may be written to a variety of output devices including, but not limited to, silver-halide film or paper writers, thermal printers, electro-photographic printers, ink-jet printers, display monitors, CD disks and other types of storage and display devices. The display image can be recorded or used, if desired, in a display material which includes but it is not limited to, a color print, a color slide, a motion picture print, an advertising display print, or an advertising display transparency, as would be readily understood in the art.

The following examples are presented to illustrate, but not limit, the practice of this invention.

MATERIALS AND METHODS FOR EXAMPLES

Photographic Film Sample 1

Photographic Film Sample 1, a film illustrating a typical multilayer multicolor light sensitive color negative photographic element useful in the invention, was prepared by applying the following layers in the given sequence to a transparent support of cellulose triacetate. The quantities of silver halide are given in grams (g) of silver per square meter. The quantities of other materials are given in grams (g) per square meter.

Layer 1 {Antihalation Layer}: DYE-1 at 0.108 g, DYE-2 at 0.022 g, Dye-3 at 0.086 g, DYE-4 at 0.108 g, SOL-1 at 0.011 g, SOL-2 at 0.011 g, with 1.6 g gelatin.

Layer 2 {Lowest Sensitivity Red-Sensitive Layer}: Red sensitive silver chloride {100}-faced tabular emulsion, average equivalent circular diameter 0.6 μm, average thickness 0.06 μm at 0.495 g, C-1 at 0.401 g, D-1 at 0.014 g, D-2 at 0.011 g, D-3 at 0.003 g, C-2 at 0.097 g, C-3 at 0.021 g, ST-1 at 0.011 g, B-1 at 0.043 g, with gelatin at 1.12 g.

Layer 3 {Medium Sensitivity Red-Sensitive Layer}: Red sensitive silver chloride {100}-faced tabular emulsion, average equivalent circular diameter 0.9 μm, average grain thickness 0.09 μm at 0.097 g, red sensitive silver chloride [100]-faced tabular emulsion, average equivalent circular diameter 1.3 μm, average grain thickness 0.12 μm at 0.129 g, C-1 at 0.132 g, D-1 at 0.0065 g, D-2 at 0.011 g, D-3 at 0.001 g, C-2 at 0.022 g, C-3 at 0.022 g, ST-1 at 0.011 g, with gelatin at 0.43 g.

Layer 4 {Highest Sensitivity Red-Sensitive Layer}: Red sensitive silver chloride {100}-faced tabular emulsion, average equivalent circular diameter 3.0 μm, average grain thickness 0.14 μm at 0.70 g, C-4 at 0.097 g, D-1 at 0.0043 g, D-2 at 0.011 g, D-3 at 0.001 g, C-2 at 0.011 g, ST-1 at 0.011 g, with gelatin at 1.28 g.

Layer 5 {Interlayer}: ST-2 at 0.11 g with 0.75 g of gelatin.

Layer 6 {Lowest Sensitivity Green-Sensitive Layer}: Green sensitive silver chloride {100}-faced tabular emulsion, average equivalent circular diameter 0.6 μm, average grain thickness 0.06 μm at 0.269 g, green sensitive silver chloride {100}-faced tabular emulsion, average equivalent circular diameter 0.9 μm, average grain thickness 0.09 μm at 0.107 g, C-5 at 0.473 g, D-1 at 0.012 g, D-2 at 0.022 g, D-4 at 0.003 g, C-6 at 0.097 g, ST-1 at 0.044 g, with gelatin at 1.18.

Layer 7 {Medium Sensitivity Green-Sensitive Layer}: Green sensitive silver chloride {100}-faced tabular emulsion, average equivalent circular diameter 0.9 μm, average grain thickness 0.09 μm at 0.086 g, green sensitive silver chloride {100}-faced tabular emulsion, average equivalent circular diameter 1.4 μm, average grain thickness 0.14 μm at 0.172 g, C-5 at 0.140 g, D-1 at 0.0065 g, D-2 at 0.0065 g, D-4 at 0.001 g, C-6 at 0.011 g, ST-1 at 0.044 g, with gelatin at 0.43 g.

Layer 8 {Highest Sensitivity Green-Sensitive Layer}: Green sensitive silver chloride {100}-faced tabular emulsion, average equivalent circular diameter 2.8 μm, average grain thickness 0.14 μm at 0.70 g, C-5 at 0.140 g, D-1 at 0.0043 g, D-2 at 0.0043 g, D-4 at 0.001 g, ST-1 at 0.044 g, with gelatin at 1.29 g.

Layer 9 {Interlayer}: ST-2 at 0.11 g with 0.75 g of gelatin.

Layer 10 {Lowest Sensitivity Blue-Sensitive Layer}: Blue sensitive silver chloride {100}-faced tabular emulsion with average equivalent circular diameter of 0.6 μm and average grain thickness of 0.06 μm at 0.161 g, and a blue sensitive silver chloride {100}-faced tabular emulsion with average equivalent circular diameter of 1.0 μm and average grain thickness of 0.1 μm at 0.108 g, C-7 at 0.861 g, D-1 at 0.016 g, D-4 at 0.001 g, D-5 at 0.054 g, ST-1 at 0.011 g, with gelatin at 0.83 g.

Layer 11 {Highest Sensitivity Blue-Sensitive Layer}: Blue sensitive silver chloride {100}-faced tabular emulsion with average equivalent circular diameter of 3.3 μm and average grain thickness of 0.15 μm at 1.02 g, C-8 at 0.172 g, D-1 at 0.011 g, D-4 at 0.001 g, D-5 at 0.011 g, ST-1 at 0.011 g, with gelatin at 0.81 g.

Layer 12 {Protective Layer-1}: DYE-4 at 0.053 g, DYE-5 at 0.053 g, and gelatin at 0.7 g.

Layer 13 {Protective Layer-2}: silicone lubricant at 0.04 g, tetraethylammonium perfluoro-octane sulfonate, silica at 0.29 g, anti-matte polymethylmethacrylate beads at 0.11 g, soluble anti-matte polymethylmethacrylate beads at 0.005 g, and gelatin at 0.89 g.

This film Sample 1 was hardened at coating with 2% by weight to total gelatin of hardener. The organic compounds were used as emulsions optionally containing coupler solvents, surfactants and stabilizers or used as solutions both as commonly practiced in the art. The coupler solvents employed in this photographic sample included: tricresylphosphate, di-n-butyl phthalate, N,N-diethyl lauramide, N,N-di-n-butyl lauramide, 2,4-di-t-amylphenol, N-butyl-N-phenyl acetamide, and 1,4-cyclohexylenedimethylene bis-(2-ethoxyhexanoate). Mixtures of compounds were employed as individual dispersions or as co-dispersions as commonly practiced in the art. The Sample 1 film additionally comprised sodium hexametaphosphate, 1,3-butanediol, 4-hydroxy-6-methyl-1,3,3a,7-tetraazaindene, 5-bromo-4-hydroxy-6-methyl-1,3,3a,7-tetraazaindene, lanothane and disodium-3,5-disulfocatechol. Silver halide emulsions employed in this sample were chemically and spectrally sensitized and comprised a silver chloride region with a surrounding iodide band, following the teaching of U.S. Pat. No. 5,314,798 (Brust), the disclosure of which is incorporated by reference. The individual emulsions comprised about 0.55 mol percent iodide based on silver. Other surfactants, coating aids, scavengers, soluble absorber dyes and stabilizers as well as various iron, lead, gold, platinum, palladium, iridium and rhodium salts were optionally added to the various emulsions and layers as is commonly practiced in the art so as to provide good preservability, processability, pressure resistance, anti-fungal and antibacterial properties, antistatic properties and coatability. The total dry thickness of all the applied layers above the support was about 18 μm while the thickness from the innermost face of the sensitized layer closest to the support to the outermost face of the sensitized layer furthest from the support was about 14 μm. Film Sample 1 contained more than about 0.2 mmol/m$^2$ of color masking coupler and more than about 0.1 mmol/m$^2$ of dyes that function as incorporated permanent Dmin adjusting dyes.

Photographic Film Sample 2

Photographic Film Sample 2, a film illustrating the preparation of a typical multilayer multicolor light sensitive color negative photographic element useful in the invention was prepared generally like Photographic Film Sample 1 except that the masking couplers C-2, C-3 and C-6 and the absorber dyes DYE-2 and DYE-3 were omitted from the sample. Film Sample 2 also contained less than about 0.2 mmol/m$^2$ of color masking couplers, and less than about 0.1 mmol/m$^2$ of dyes that function as incorporated permanent Dmin adjusting dyes.

Photographic Film Sample 3

Photographic Film Sample 3, a film illustrating the preparation of a typical comparison multilayer multicolor light sensitive color negative photographic element was prepared generally like Photographic Film Sample 1 except that the light sensitive high chloride tabular grain emulsions were all replaced by similar quantities of similarly sensitized AgIBr tabular grain emulsions. These AgIBr emulsions comprised about 96 mol % silver bromide and about 4 mol % silver iodide, and were generally prepared following the procedures described in U.S. Pat. No. 4,439,520 (Kofron, et al). These emulsions were further characterized in comprising a AgIBr core with a surrounding iodide band or shell structure similar to that employed in the tabular AgCl emulsions useful in the practice of the invention.

List of Compounds Used in Photographic Film Samples

DYE-1
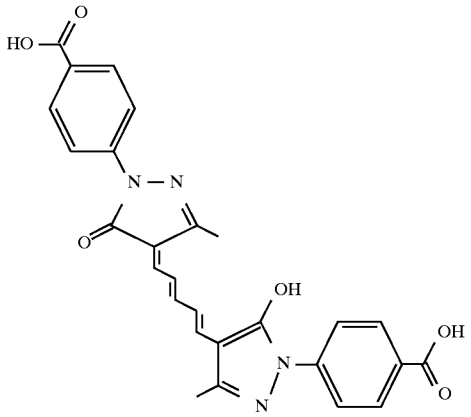
DYE-2
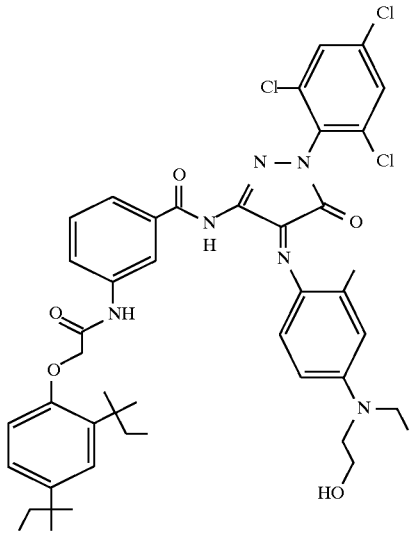
DYE-3
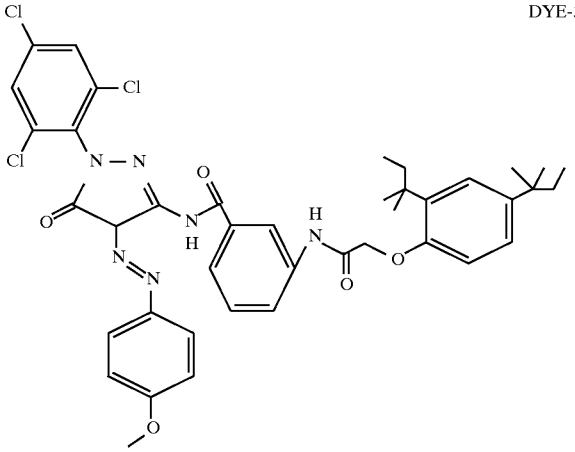
DYE-4
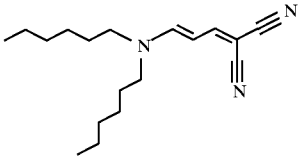
SOL-1
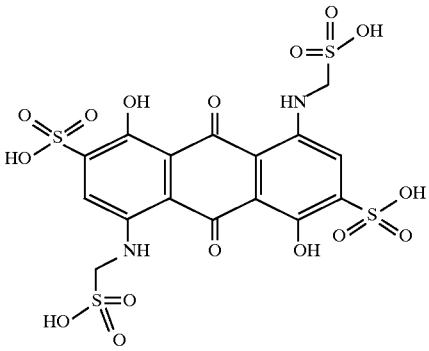
SOL-2
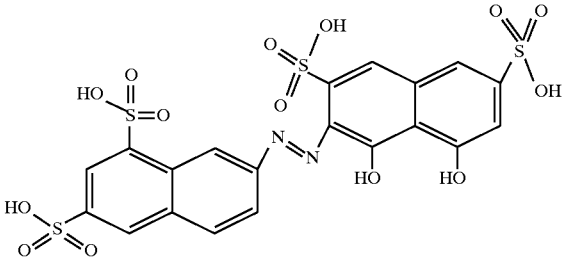

-continued
C-1
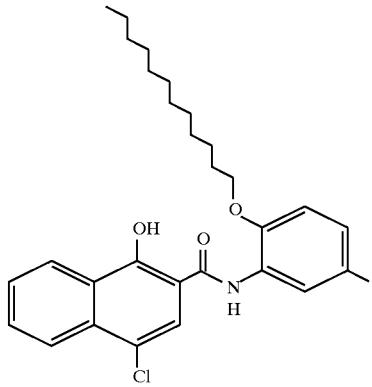
D-1
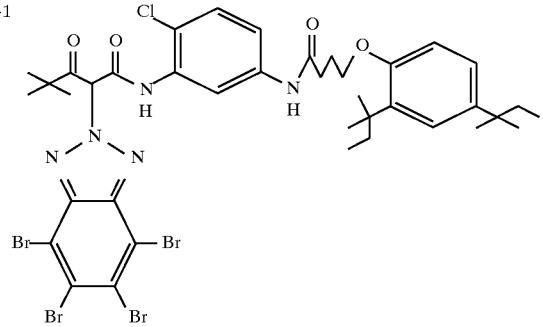
D-2
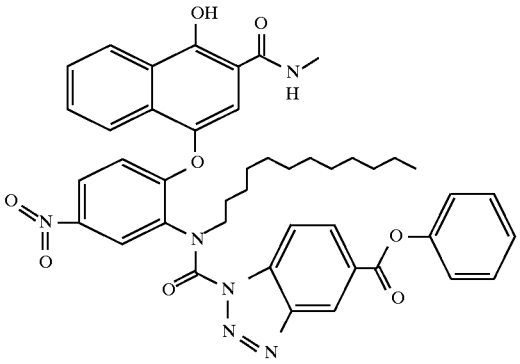
D-3
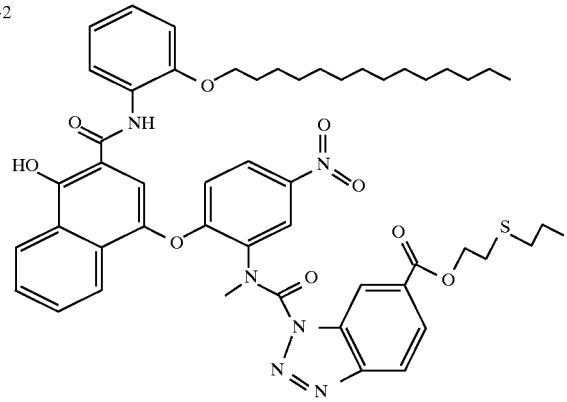
B-1
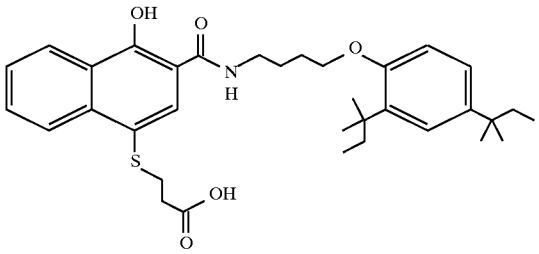
C-2
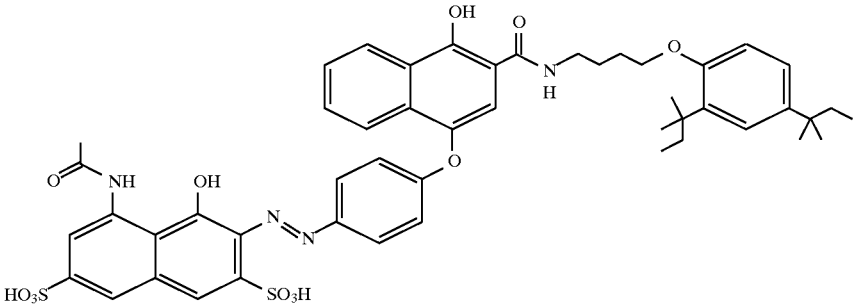

-continued
C-3
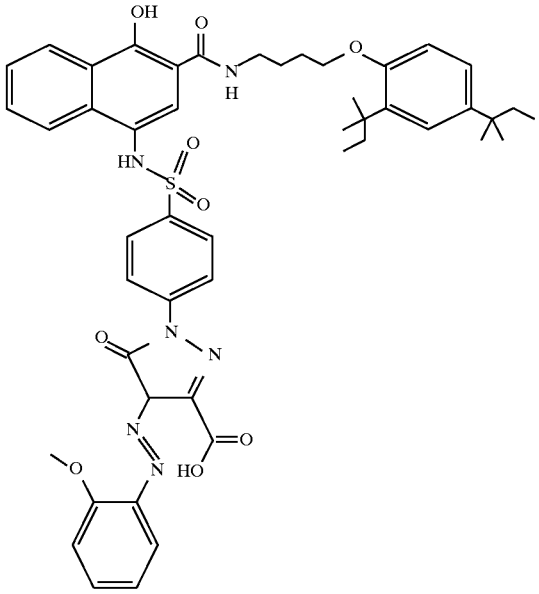
ST-1
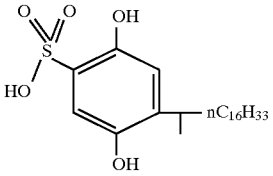
C-4
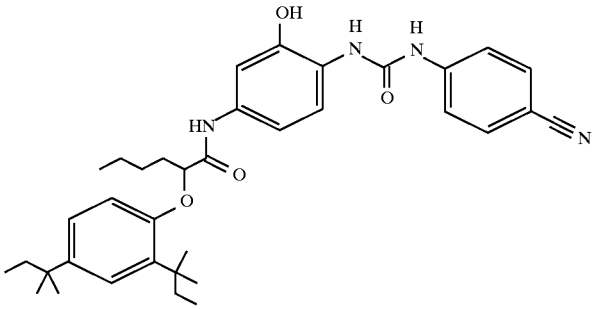
ST-2
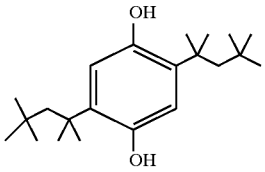
C-5
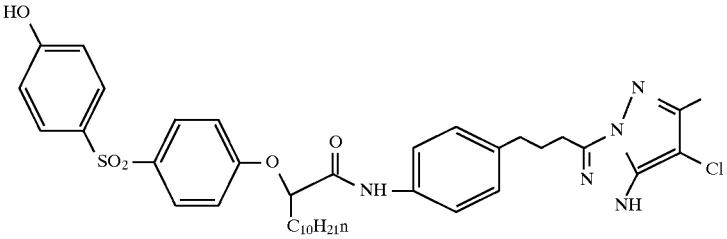
D-4
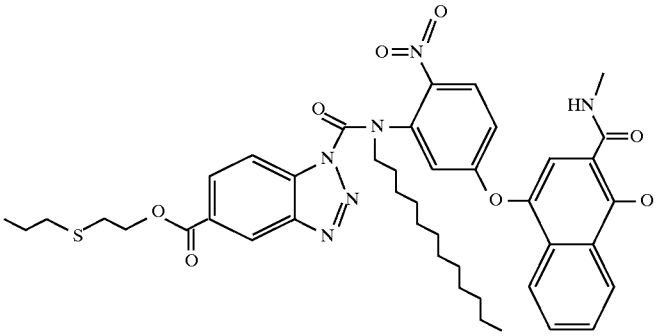

-continued

C-6

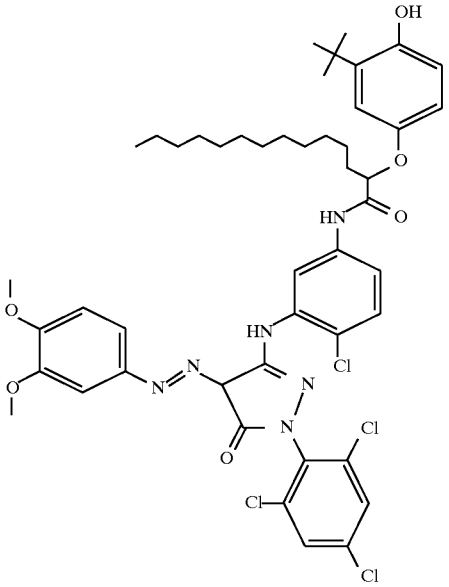

C-7

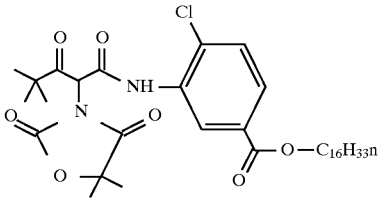

D-5

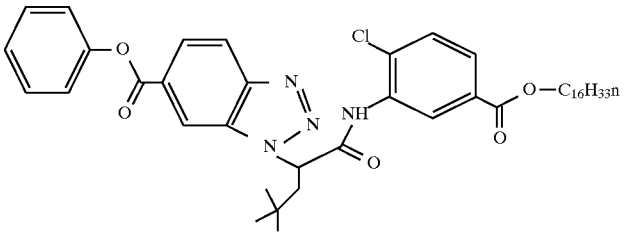

C-8

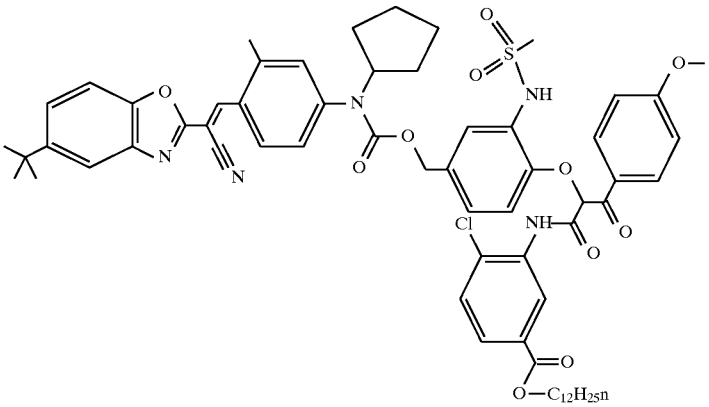

DYE-5

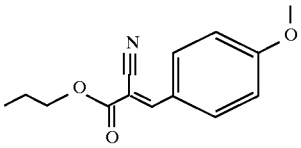

Processing Solutions

The following color processing solutions were used in the following examples:

Color Developer I was formulated by adding water, 34.3 g of potassium carbonate, 2.32 g potassium bicarbonate, 0.38 g of anhydrous sodium sulfite, 2.96 g of sodium metabisulfite, 1.2 mg of potassium iodide, 1.31 g of sodium bromide, 8.43 g of a 40% solution of diethylenetriaminepentaacetic acid pentasodium salt, 2.41 g of hydroxylamine sulfate, 4.52 g of (N-(4-amino-3-methylphenyl)-N-ethyl-2-aminoethanol) as a sulfuric acid salt and sufficient additional water and sulfuric acid or potassium hydroxide to make 1 liter of solution at a pH of 10.00±0.05 at 26.7° C.

Color Developer II was formulated by adding water, 320.0 g of potassium carbonate, 32.56 g of anhydrous sodium sulfite, 8.0 g of sodium bromide, 32.0 g of potassium chloride, 28.0 g of diethylenetriaminepentaacetic acid pentasodium salt, 19.28 g of hydroxylamine sulfate, 80.0 g of (N-(4-amino-3-methylphenyl)-N-ethyl-2-aminoethanol) as a sulfuric acid salt and sufficient additional water and sulfuric acid or potassium hydroxide to make 8 liters of solution at a pH of 10.00±0.05 at 26.7° C.

Color Developer III was formulated by adding water, 320.0 g of potassium carbonate, 32.56 g of anhydrous sodium sulfite, 20.0 g of sodium bromide, 32.0 g of potassium chloride, 28.0 g of diethylenetriaminepentaacetic acid pentasodium salt, 19.28 g of hydroxylamine sulfate, 120.0 g of (N-(4-amino-3-methylphenyl)-N-ethyl-2-aminoethanol) as a sulfuric acid salt and sufficient additional water and sulfuric acid or potassium hydroxide to make 8 liters of solution at a pH of 10.00±0.05 at 26.7° C.

Bleach I was formulated by adding water, 37.4 of 1,3-propylenediamine tetraacetic acid, 70 g of a 57% ammonium hydroxide solution, 80 g of acetic acid, 0.8 g of 2-hydroxy-1,3-propylenediamine tetraacetic acid, 25 g of ammonium bromide, 44.85 g of ferric nitrate nonahydrate an sufficient water and acid or base to make 1 liter of solution at a pH of 4.75.

Bleach II was formulated by adding to water 113.6 g of 1,3-propylenediamine tetraacetic acid, 51.5 g of acetic acid, 94.7 g of ammonium bromide, and 0.95 g of 2-hydroxy-1,3-propylenediamine tetraacetic acid, 136.9 g of ferric nitrate nonahydrate and sufficient water and ammonium hydroxide to make 1 liter of solution at a pH of 4.5.

Fix I was formulated by adding water, 214 g of a 58% solution of ammonium thiosulfate, 1.29 g of (ethylenedinitrilo)tetraacetic acid disodium salt dihydrate, 11 g of sodium metabisulfite, 4.7 g of a 50% solution of sodium hydroxide and sufficient water and acid or base to make 1 liter of solution at a pH 6.5.

Fix II was formulated by adding water, 194 g of a 58% solution of ammonium thiosulfate, 1.2 g of (ethylenedinitrilo)tetraacetic acid disodium salt dihydrate, 7.94 g of ammonium sulfite, 14 g of sodium sulfite, 138 g of ammonium thiocyanate, 4.78 g of glacial acetic acid and sufficient water and ammonium hydroxide or sulfuric acid to make 1 liter of solution at a pH 6.2.

A rinse solution was formulated by adding 0.4 g of 50% ZONYL™ FSO in water, 1.6 g of NEODOL 25-7, and 5.34 ml of 1.5% Kathon LX in water to sufficient water to make 8 liters of a solution with a pH of about 8.3.

Description of Photographic Processes

The following processing protocols and conditions were used in the following examples.

| STEP | TIME | SOLUTION | TEMPERATURE |
|---|---|---|---|
| Process A: | | | |
| Develop | 195 seconds | Color Developer I | 38° C. |
| Bleach | 240 seconds | Bleach I | 38° C. |
| Wash | 180 seconds | Water | 35° C. |
| Fix | 240 seconds | Fixer I | 38° C. |
| Wash | 180 seconds | Water | 35° C. |
| Rinse | 60 seconds | Rinse | 35° C. |
| Rapid Process B: | | | |
| Develop | 90 seconds | Color Developer I | 38° C. |
| Bleach | 60 seconds | Bleach I | 38° C. |
| Fix | 60 seconds | Fixer I | 38° C. |
| Wash | 60 seconds | Water | 35° C. |
| Rinse | 60 seconds | Rinse | 35° C. |
| Rapid Process C: | | | |
| Develop | 30 seconds | Color Developer II | 50° C. |
| Bleach | 30 seconds | Bleach II | 50° C. |
| Fix | 30 seconds | Fixer II | 50° C. |
| Wash | 30 seconds | Water | 50° C. |
| Rinse | 10 seconds | Rinse | 50° C. |
| Rapid Process D: | | | |
| Develop | 15 seconds | Color Developer III | 60° C. |

-continued

| STEP | TIME | SOLUTION | TEMPERATURE |
|---|---|---|---|
| Bleach | 15 seconds | Bleach II | 60° C. |
| Fix | 15 seconds | Fixer II | 60° C. |
| Wash | 15 seconds | Water | 60° C. |
| Rinse | 10 seconds | Rinse | 60° C. |

Photographic Film Samples 1 and 2 exhibited sensitivities in excess of ISO 100 after imagewise exposure and processing in accordance with Processes A, B, C and D. Photographic Film Sample 3 exhibited sensitivity in excess of ISO 100 after Process A.

Comparison Imaging Example

Imagewise exposed samples of Photographic Film Sample 1 were processed using Rapid Process B. The developed color negative samples were then optically printed using an enlarger calibrated to match a neutral density of 0.70±0.03 for a specific patch of the target. The scanner density representative digital signals obtained for a broad range of neutral exposures, were determined as described below, and combined with their known exposures to describe film characteristic curves [scanner density vs. relative log(exposure) curves] for the three color records as shown in FIG. 1.

Imaging Example 1

Photographic Film Sample 1 was given an imagewise exposure and processed using Rapid Process C. The developed color negative samples were then optically printed using an enlarger and calibrated to match a neutral density of 0.70±0.03 for a specific patch of the target.

The average standard deviations of resulting Status A density differences between the optical prints from the color negative film processed using Rapid Process C and the optical prints from the color negative film processed using Rapid Process B (Comparison Imaging Example) were calculated from the following equations for the set of color patches of varying density and hue:

$$S_R = \sqrt{\frac{\sum_1^n (R_A - R_E)^2}{n-1}}$$

$$S_G = \sqrt{\frac{\sum_1^n (G_A - G_E)^2}{n-1}}$$

$$S_B = \sqrt{\frac{\sum_1^n (B_A - B_E)^2}{n-1}}$$

The sample standard deviations of the three color records were then averaged using the equation:

$$\bar{S}_{avg} = \frac{S_R + S_G + S_B}{3}$$

to give an indication of the overall differences in color and tone scale reproduction between the two systems. These data are tabulated in TABLE I below ($\bar{S}_{avg}$). The data indicate that the color negative film processed in the manner described above results in a reduced quality final image. This difference in output color reproduction would be present for any light-sensitive output material.

However, the differences in color and tone scale can be measured and used to derive a digital correction factor that would result in a closer match between display images based on a color negative film processed using Rapid Process B and the color negative film processed using the method of this invention. As described hereinabove, there are a number of ways of deriving the correction factor and the use of a particular method in these examples is not intended to limit the means that may be used to calculate the correction factor. The film samples being calibrated were given a series of known exposures, including neutral patches of varying densities, and a variety of combinations of red, green and blue exposures.

The exposed film samples were then processed as described above to form negative film images having cyan, magenta and yellow dye densities which varied in an imagewise fashion. A digital representation of these negatives were obtained by means of a conventional optoelectronic scanner. The details of creating this digital representation are well known in the art. The scanner density representative density signals for each pixel may be described as $R_{SD}$, $G_{SD}$ and $B_{SD}$.

In conventional color negative films, there are significant interactions between the different color records where the development in one color record may affect the density achieved in the other color records. A matrix describing these interactions between color records may be derived from the scanner density representative digital signals ($R_{SD}$, $G_{SD}$, $B_{SD}$) of the various patches and the exposures used to generate the patches using standard regression techniques. This matrix may be thought of as describing the transformation of channel independent density signals ($R_{CI}$, $G_{CI}$, $B_{CI}$) (those densities which would have formed if there were no interactions between the color records) to the scanner density representative digital signals ($R_{SD}$, $G_{SD}$, $B_{SD}$) (i.e., the densities that formed including the interactions between the different color records). The inverse of this matrix was also calculated. This second matrix converts scanner density representative digital signals ($R_{SD}$, $G_{SD}$, $B_{SD}$) to channel independent density representative digital signals ($R_{CI}$, $G_{CI}$, $B_{CI}$).The equation below describes the calculation of channel independent densities for the test film when processed as described above. The matrix shown is a 3×3 matrix. Obviously, more precision could be obtained with a higher order matrix or a multidimensional lookup table.

$$\begin{bmatrix} R_{CI} \\ G_{CI} \\ B_{CI} \end{bmatrix} = \begin{bmatrix} 0.749 & 0.023 & 0.227 \\ 0.048 & 0.723 & 0.229 \\ -0.216 & 0.311 & 1.522 \end{bmatrix} \begin{bmatrix} R_{SD} \\ G_{SD} \\ B_{SD} \end{bmatrix}$$

Figure 2:
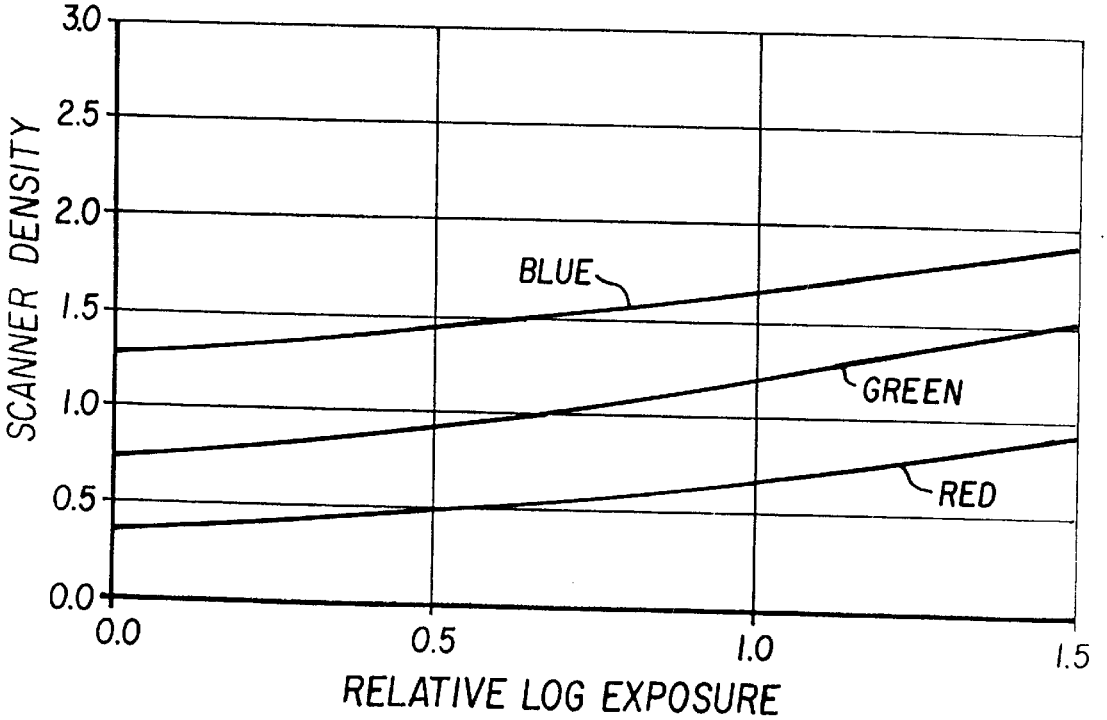
FIG. 2 shows the scanner density representative signals as a function of log Exposure for Film Sample 1 developed according to Rapid Process C as explained in Imaging Example 1 below.

The scanner density representative digital signals ($R_{SD}$, $G_{SD}$, $B_{SD}$) obtained for a broad range of neutral exposures, were combined with their known exposures to describe film characteristic curves [scanner density vs. relative log (exposure) curves] for the three color records as shown in FIG. 2. The scanner density representative digital signals ($R_{SD}$, $G_{SD}$, $B_{SD}$) of the film characteristic curve were then converted to channel independent density representative digital signals ($R_{CI}$, $G_{CI}$, $B_{CI}$) using the equation shown above. This is desirable because there is a one to one relationship between log(exposure) and the channel independent density representative digital signals. The channel independent density digital signal ($R_{CI}$, $G_{CI}$, $B_{CI}$) vs. log (exposure) curves were then inverted to form log(exposure) vs. channel independent density digital signal ($R_{CI}$, $G_{CI}$, $B_{CI}$) curves. The curves for the three color records can be thought of as a series of 1-dimensional look-up tables that convert channel independent density digital signals ($R_{CI}$, $G_{CI}$, $B_{CI}$) to digital log(exposure) representative signals ($R_{LE}$, $G_{LE}$, $B_{LE}$).

The scanner density representative digital signals ($R_{SD}$, $G_{SD}$, $B_{SD}$) were converted to the log(exposure) representative digital signals ($R_{LE}$, $G_{LE}$, $B_{LE}$) of an image in the following manner. The scanner density representative digital signals ($R_{SD}$, $G_{SD}$, $B_{SD}$) were converted to channel independent density digital signals ($R_{CI}$, $G_{CI}$, $B_{CI}$) by using the matrix shown above. The channel independent density digital signals ($R_{CI}$, $G_{CI}$, $B_{CI}$) are then converted to digital log(exposure) representative digital signals ($R_{LE}$, $G_{LE}$, $B_{LE}$) of an image. The digitized image was now in a form that was independent of the chemical processing used to form the dye density image. The means for producing desirable output from scene log(exposures) is well known in the art. The log(exposure) representative digital signals ($R_{LE}$, $G_{LE}$, $B_{LE}$) could then be transformed in a variety of ways to produce desirable output. If the desire is to explicitly match the image that would have been produced had the color negative film been processed with Rapid Process B, the calculated log(exposure) representative digital signals ($R_{LE}$, $G_{LE}$, $B_{LE}$) can be transformed through a model of the interlayer interactions and tone scale associated with the specific film processed through the standard process, resulting in a description of the image in terms of aim film density representative digital signals ($R_{AIM}$, $G_{AIM}$, $B_{AIM}$). These aim film density representative digital signals ($R_{AIM}$, $G_{AIM}$, $B_{AIM}$) can then be processed as appropriate for the desired output device. This was done and the average standard deviation resulting from Status A density differences between an image formed from a color negative processed according to this invention and the image formed from a negative processed using Rapid Process B were calculated from the above equations and is tabulated in TABLE I below.

Imaging Example 2

Photographic Film Sample 1 was given an imagewise exposure and processed using Rapid Process D. This reduction in process time further degrades the image quality obtained from an optical print as seen in Table I below. The developed color negative samples were optically printed using an enlarger and calibrated to match a neutral density of 0.70±0.03 for a specific patch of the target. The sample standard deviation in Status A density*100 for the different patches between this example and the comparison position of Photographic Film Sample 1 color developed using Rapid Process B (Comparison Imaging Example) was calculated for the 3 color records, and then averaged over the 3 color records. These data are recorded in TABLE I below.

Figure 3:
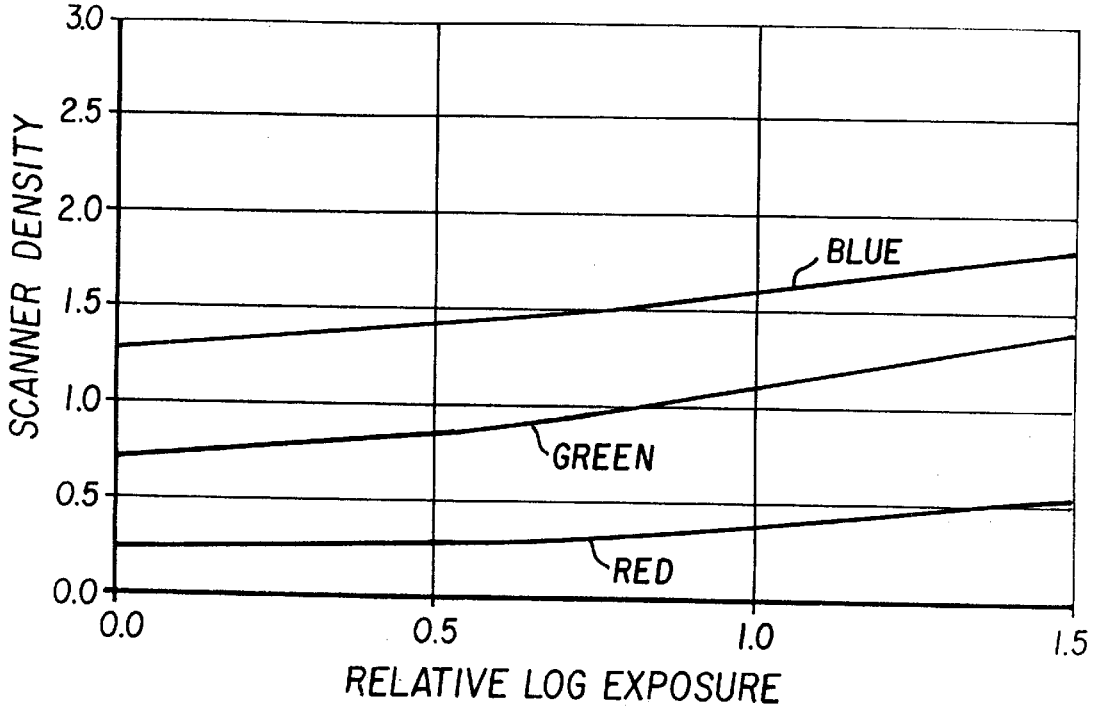
FIG. 3 shows the scanner density representative signals as a function of log Exposure for Film Sample 1 developed according to Rapid Process D as explained in Imaging Example 2 below.

The resulting film negatives were then scanned and digitally corrected using a correction factor calculated in the manner described above. For this particular processing time and formulation there were, as expected, differences in the chemical interactions between the different color records and differences in the film's characteristic curve. The characteristic curves of scanner density representative signals ($R_{SD}$, $G_{SD}$, $B_{SD}$) vs. log exposure are shown in FIG. 3.

The following matrix shows the conversion of scanner density representative signals ($R_{SD}$, $G_{SD}$, $B_{SD}$) to channel independent density representative digital signals ($R_{CI}$, $G_{CI}$, $B_{CI}$) for the described film and process combination of this example.

$$\begin{bmatrix} R_{CI} \\ G_{CI} \\ B_{CI} \end{bmatrix} = \begin{bmatrix} 0.771 & 0.133 & 0.097 \\ 0.241 & 0.474 & 0.285 \\ -0.216 & -0.433 & 1.648 \end{bmatrix} \begin{bmatrix} R_{SD} \\ G_{SD} \\ B_{SD} \end{bmatrix}$$

The sample standard deviation in Status A density * 100 for patches of the digitally corrected image formed from the described film and process combination compared to the digitally corrected image formed from the Comparison Imaging Example is described in TABLE I below.

Imaging Example 3

Photographic Film Sample 2 was given an imagewise exposure and color developed using Rapid Process B. The developed color negative film was optically printed using an enlarger calibrated to match a neutral density of 0.70±0.03 for a specific patch of the target. The sample standard deviation in Status A density*100 for the different patches between this example and the Comparison Imaging Example was calculated for the 3 color records, and then averaged over the three color records. The data are recorded in TABLE I below.

Figure 4:
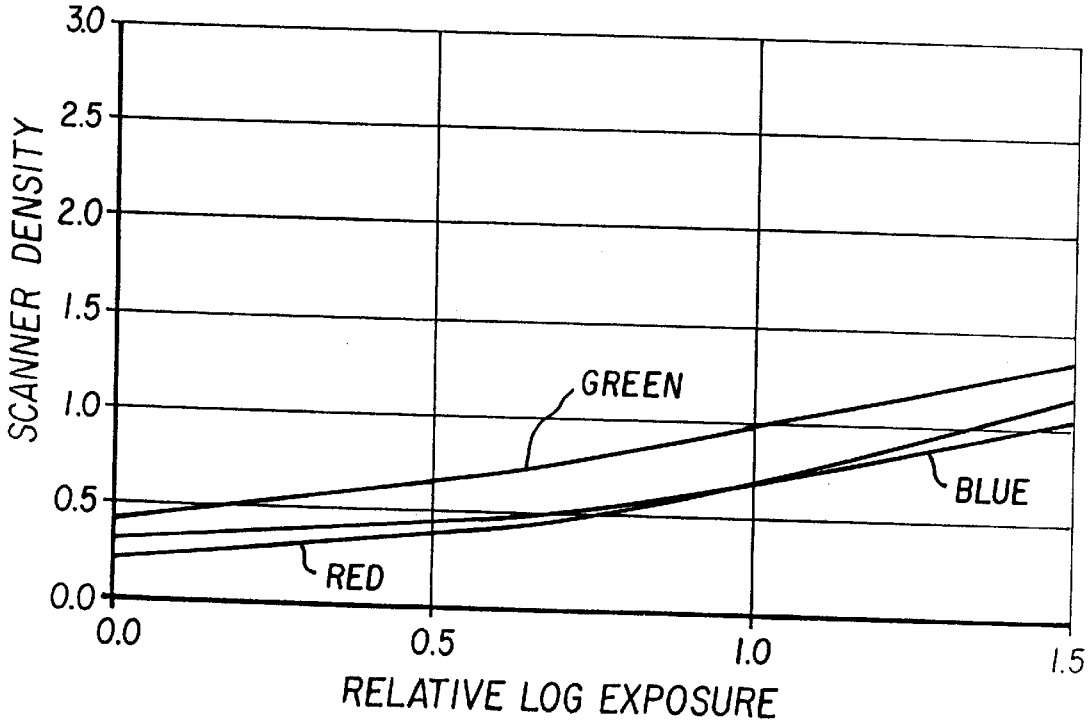
FIG. 4 shows the scanner density representative signals as a function of log Exposure for Film Sample 2 developed according to Rapid Process B as explained in Imaging Example 3 below.

These film negatives were then scanned and digitally corrected using a correction factor calculated in the manner described above. For this particular processing time and formulation there were, as expected, differences in the chemical interactions between the different color records and differences in the film's characteristic curve. The characteristic curves of scanner density representative signals ($R_{SD}$, $G_{SD}$, $B_{SD}$) vs. log exposure are shown in FIG. 4.

The following matrix shows the conversion of scanner density representative signals ($R_{SD}$, $G_{SD}$, $B_{SD}$) to channel independent density representative digital signals ($R_{CI}$, $G_{CI}$, $B_{CI}$) for the described film and process combination of this example.

$$\begin{bmatrix} R_{CI} \\ G_{CI} \\ B_{CI} \end{bmatrix} = \begin{bmatrix} 0.8120 & 0.0478 & 0.1403 \\ 0.0059 & 0.8589 & 0.1353 \\ -0.726 & -0.2300 & 1.3030 \end{bmatrix} \begin{bmatrix} R_{SD} \\ G_{SD} \\ B_{SD} \end{bmatrix}$$

The sample standard deviation in Status A density*100 for patches of the digitally corrected image formed from the described film and process combination compared to the digitally corrected image formed from the Comparison Imaging Example are described in TABLE I below.

Imaging Example 4

Photographic Film Sample 2 was given an imagewise exposure and processed using Rapid Process C. The developed color negative film was then optically printed using an enlarger calibrated to match a neutral density of 0.70±0.03 for a specific patch of the target. The sample standard deviations in Status A density * 100 between this example and the Comparison Imaging Example were calculated for the 3 color records, and then averaged over the three color records. These data are recorded in TABLE I below.

Figure 5:
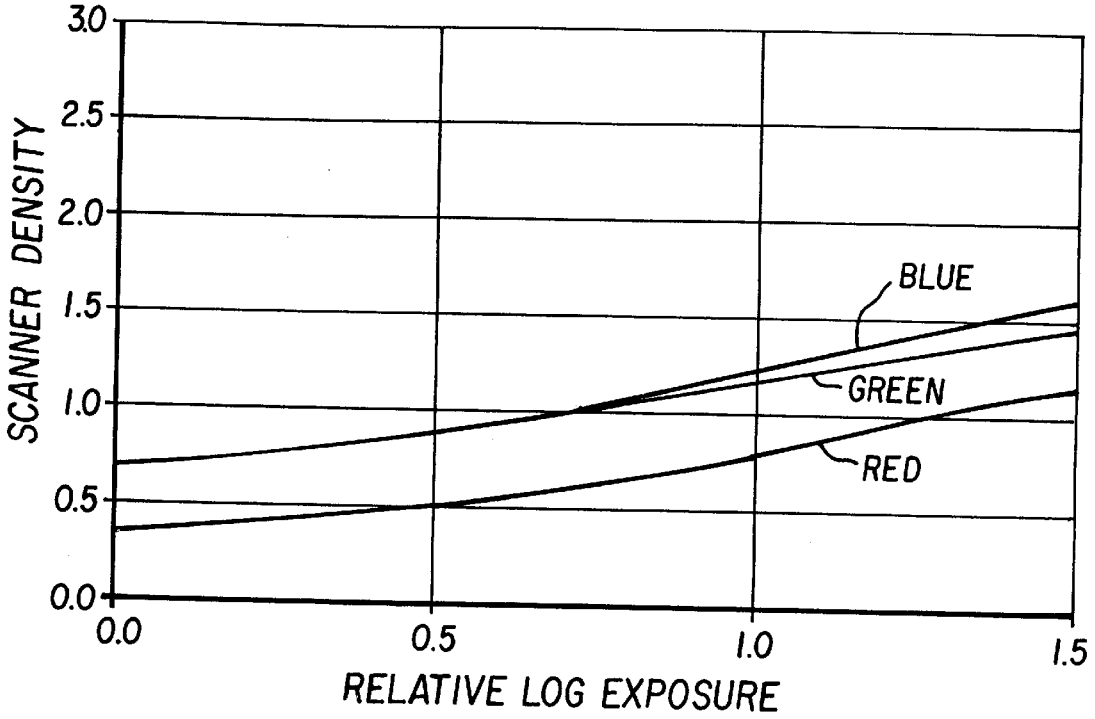
FIG. 5 shows the scanner density representative signals as a function of log Exposure for Film Sample 2 developed according to Rapid Process C as explained in Imaging Example 4 below.

These film negatives were then scanned and digitally corrected using a correction factor calculated in the manner described above. For this particular processing time and formulation there were, as expected, differences in the chemical interactions between the different color records and differences in the film's characteristic curve. The characteristic curves of scanner density representative signals ($R_{SD}$, $G_{SD}$, $B_{SD}$) vs. log exposure are shown in FIG. 5.

The following matrix shows the conversion of scanner density representative signals ($R_{SD}$, $G_{SD}$, $B_{SD}$) to channel independent density representative digital signals ($R_{CI}$, $G_{CI}$, $B_{CI}$) for the described film and process combination of this example.

$$\begin{bmatrix} R_{CI} \\ G_{CI} \\ B_{CI} \end{bmatrix} = \begin{bmatrix} 0.8463 & 0.0653 & 0.0884 \\ 0.0127 & 0.8585 & 0.1288 \\ -0.0949 & -0.3536 & 1.448 \end{bmatrix} \begin{bmatrix} R_{SD} \\ G_{SD} \\ B_{SD} \end{bmatrix}$$

The sample standard deviation in Status A density*100 for patches of the digitally corrected image formed from the described film and process combination compared to the digitally corrected image formed from the Comparison Imaging Example are described in TABLE I below.

Imaging Example 5

Photographic Film Sample 2 was given an imagewise exposure and developed using Rapid Process D. The developed color negative sample was optically printed using an enlarger calibrated to match a neutral density of 0.70±0.03 for a specific patch of the target. The sample standard deviations in Status A density*100 between this example and the Comparison Imaging Example were calculated for the 3 color records, and then averaged over the three color records. These data are recorded in TABLE I below.

Figure 6:
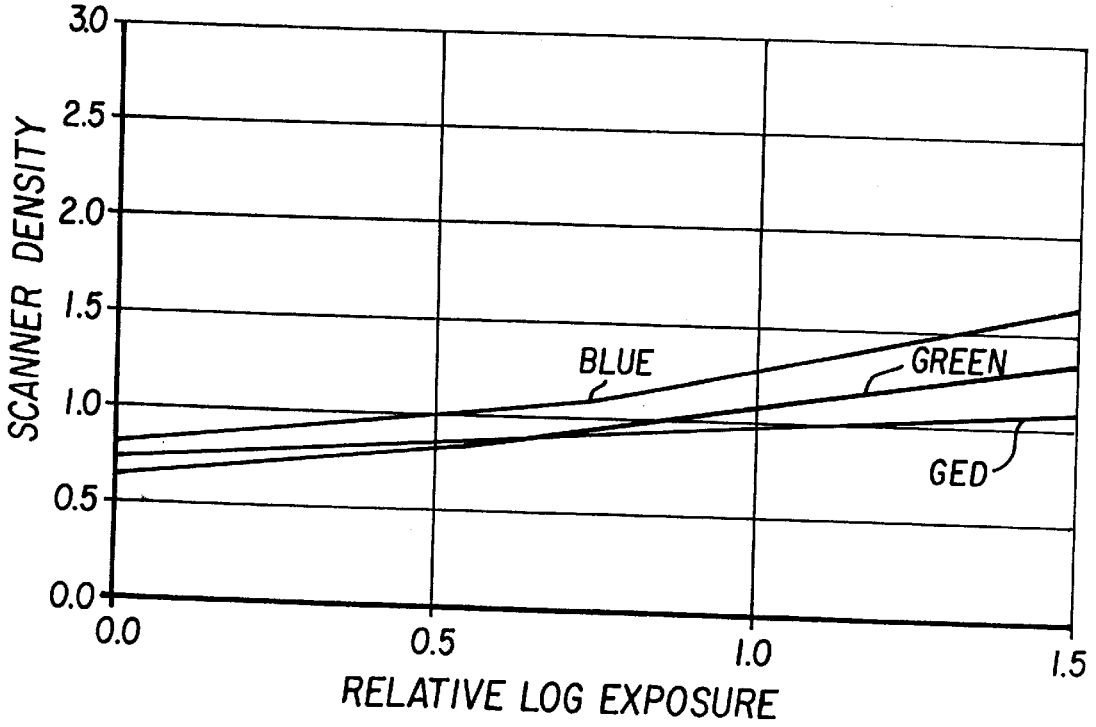
FIG. 6 shows the scanner density representative signals as a function of log Exposure for Film Sample 1 developed according to Rapid Process D as explained in Imaging Example 5 below.

These film negatives were then scanned and digitally corrected using a correction factor calculated in the manner described above. For this particular processing time and formulation there were, as expected, differences in the chemical interactions between the different color records and differences in the film's characteristic curve. The characteristic curves of scanner density representative signals ($R_{SD}$, $G_{SD}$, $B_{SD}$) vs. log exposure are shown in FIG. 6.

The following matrix shows the conversion of scanner density representative signals ($R_{SD}$, $G_{SD}$, $B_{SD}$) to channel independent density representative digital signals ($R_{CI}$, $G_{CI}$, $B_{CI}$) for the described film and process combination.

$$\begin{bmatrix} R_{CI} \\ G_{CI} \\ B_{CI} \end{bmatrix} = \begin{bmatrix} 0.7024 & 0.2170 & 0.0806 \\ 0.0983 & 0.7171 & 0.1846 \\ -0.0942 & -0.3451 & 1.4390 \end{bmatrix} \begin{bmatrix} R_{SD} \\ G_{SD} \\ B_{SD} \end{bmatrix}$$

The sample standard deviation in Status A density*100 for patches of the digitally corrected image formed from the described film and process combination compared to the digitally corrected image formed from the Comparison Imaging Example are described in TABLE I below.

Description of Tables I and II

TABLE I shows the average standard deviation in Status A density*100 between optical prints of images prepared from Photographic Film Samples 1 or 2 when color developed using Rapid Process B, C or D relative to the Comparison Imaging Example. These data include the red (R), green (G) and blue (B) color records individually, the average of the color records ("$\overline{S}_{avg}$") as well as the spread in error between the color records (Spread). Perfect color reproduction would be represented by an error term of zero. These data are indicative of the magnitude of the color error induced by changes in processing conditions. In all cases, smaller values are preferred.

Also shown are the same data for digitally corrected images according to the present invention. It can be seen that the digitally corrected images give similar or reduced deviations in average sample standard deviations compared to the optical prints, thus suggesting that the digitally corrected images offer superior color reproduction. The digitally corrected images have the benefit of having the majority of errors in color reproduction corrected. Additionally they show the benefit of having residual errors in color reproduction distributed evenly across the three color records as shown by the spread. In another embodiment, the errors in color reproduction can be concentrated in human eye insensitive color regimes thus producing pictures that are visually extremely pleasing.

TABLE II shows the same optical to digitally corrected comparisons of sample standard deviation averaged over the three color records for the situation when the target patches are limited to those giving a neutral exposure. This illustrates that display images produced according to the present invention will not have a color cast and thus can be less sensitive to changes in the processing conditions employed in developing the images.

TABLE I

| | Comparative Optical Deviations in Status A * 100 | | | | | Invention Digital Deviations in Status A * 100 | | | | |
|---|---|---|---|---|---|---|---|---|---|---|
| Example | R | G | B | $\bar{S}_{avg}$ | Spread | R | G | B | $\bar{S}_{avg}$ | Spread |
| Invention 1 | 10 | 6 | 6 | 7 | 4 | 7 | 7 | 12 | 5 | 5 |
| Invention 2 | 32 | 11 | 9 | 17 | 23 | 12 | 16 | 17 | 14 | 5 |
| Invention 3 | 17 | 9 | 12 | 13 | 8 | 4 | 5 | 15 | 7 | 11 |
| Invention 4 | 13 | 7 | 11 | 10 | 6 | 9 | 8 | 15 | 9 | 7 |
| Invention 5 | 32 | 11 | 13 | 18 | 21 | 27 | 12 | 16 | 17 | 15 |

TABLE II

| Example | Comparative Optical $S_{avg}$ (Status A * 100) | Ivention Digital $S_{avg}$ (Status A * 100) |
|---|---|---|
| Invention 1 | 8 | 2 |
| Invention 2 | 20 | 1 |
| Invention 3 | 17 | 3 |
| Invention 4 | 11 | 2 |
| Invention 5 | 19 | 3 |

As is readily apparent upon examination of the comparative and invention $\bar{S}_{avg}$ values in Tables I and II, the present invention provides surprisingly improved color output as indicated by the smaller invention $\bar{S}_{avg}$ values after extremely rapid photographic development, thus demonstrating a beneficial outcome of the use of the present invention.

EXAMPLE 6

Visual Confirmation

Portions of Photographic Film Samples 1, 2 and 3 were slit to a width of 35 mm, perforated and encased in film canisters. These canisters were then individually loaded into a single lens reflex camera and pictures of both test objects and human subjects were exposed. Photographs taken on portions of Film Sample 1 were color developed using Rapid Process B, C or D. Photographs taken on portions of film Sample 2 were likewise developed using Rapid Process B, C or D. Photographs taken on portions of Film Sample 3 were developed using Process A. In one series of experiments, the negative images were optically printed with an 18% test scene gray patch forced to a neutral print density of about 0.70. In another series of experiments, the negative images were scanned, digitized and color corrected according to the present invention. The resulting digitized color corrected images were digitally printed again with an 18% test scene gray patch at a neutral print density of about 0.70. In all cases, the digitally corrected images were judged to exhibit superior color reproduction relative to the corresponding uncorrected optically printed images, thus visually confirming the benefits of the present invention.

The invention has been described in detail with particular reference to preferred embodiments thereof, but it will be understood that variations and modifications can be effected within the spirit and scope of the invention.

We claim:

1. A method of providing a color display image comprising the steps of:

A) color developing an imagewise exposed silver halide film having a support that is substantially transparent after photographic processing, and having thereon a coated layer thickness of up to about 30 $\mu$m, and at least three color records, each color record having at least one silver halide emulsion, said film further comprising up to about 0.2 mmol/m$^2$ of color masking coupler, each said developed color record exhibiting a gamma of between about 0.1 and 1.0 and an exposure latitude of from 2.5 log E to 6.0 log E, and said film exhibiting a photographic sensitivity of at least ISO 100, B) scanning said developed film to form density representative digital signals for said at least three color records, and C) digitally manipulating said density representative digital signals formed in step B to correct either or both interimage interactions and gamma mismatches among said at least three color records so as to produce a digital record of said corrected color image.

2. The method of claim 1 wherein color development is carried out for up to 195 seconds.

3. The method of claim 2 wherein color development is carried out for up to 120 seconds.

4. The method of claim 1 wherein said film comprises a red color record having a peak spectral sensitivity between about 600 and about 700 nm, a green color record having a peak spectral sensitivity between about 500 and about 600 nm, and a blue color record having a peak spectral sensitivity between about 400 and about 500 nm, each color record having at least one predominantly silver bromide emulsion, said film exhibiting a photographic sensitivity of at least ISO 100 and having at least one predominantly silver bromide emulsion comprising tabular grains having an average aspect ratio of at least 2 and bounded by predominantly {111} major faces, said film also having an exposure latitude of from 3.0 log E to 6.0 log E, and exhibiting a gamma of between about 0.1 and 1.0.

5. The method of claim 1 wherein at least one silver halide emulsion in the film is composed of silver halide grains that have a grain core surrounded by a band comprising a higher level of silver iodide than is present in said core, and comprising from about 0.1 to about 10% of the silver in the grain.

6. The method of claim 4 wherein each of said predominantly silver bromide emulsions has less than 5 mol % silver iodide.

7. The method of claim 6 wherein each of said predominantly silver bromide emulsions has less than 2 mol % silver iodide.

8. The method of claim 1 wherein color development is carried out with a color developer having a pH of from about 9 to about 12, and comprising:

a color developing agent at from about 0.01 to about 0.1 mol/l, and bromide ion at from about 0.003 to about 0.1 mol/l.

9. A method for providing a color display image comprising the steps of:

A) color developing for up to 90 seconds an imagewise exposed silver halide film having a support that is substantially transparent after processing, and having thereon a coated layer thickness of up to about 24 $\mu$m, and a red color record having a peak spectral sensitivity between about 600 and about 700 nm, a green color record having a peak spectral sensitivity between about 500 and about 600 nm, and a blue color record having a peak spectral sensitivity between about 400 and about 500 nm, each color record having at least one predominantly silver bromide emulsion, said film exhibiting a photographic sensitivity of at least ISO 100 and having at least one predominantly silver bromide emulsion comprising tabular grains having an average aspect ratio of at least 2 and bounded by predominantly {111} major faces, said film having an exposure latitude of 3.0 log E or more, exhibiting a gamma of between about 0.1 and 1.0, said film further comprising up to about 0.1 mmol/m$^2$ of incorporated permanent Dmin adjusting dye, and up to about 0.2 mmol/m$^2$ of color masking coupler, with a color developer having a pH of from about 9 to about 12, and comprising:

a color developing agent at from about 0.01 to about 0.1 mol/l, and bromide ion at from about 0.003 to about 0.1 mol/l, said color developing being carried out at a temperature of at least 35° C., B) scanning said developed film to form density representative digital signals for said at least two color records, and C) digitally manipulating said density representative digital signals formed in step B to correct either or both interimage interactions and gamma mismatches among said at least two color records so as to produce a digital record of said corrected color image.

10. The method of claim 9 wherein said color masking coupler is present in an amount of up to 0.05 mmol/m$^2$, and said incorporated permanent Dmin adjusting dye is present in an amount of up to 0.02 mmol/m$^2$.

11. The method of claim 9 wherein each of said predominantly silver bromide emulsions in the film is composed of silver halide grains that have a grain core surrounded by a band comprising a higher level of silver iodide than is present in said core, and comprising from about 0.1 to about 10% of the silver in the grain.

12. The method of claim 9 wherein said red color record has a peak spectral sensitivity between about 595 and 615 nm, said green color record has a peak spectral sensitivity of between about 530 and 545 nm, and said blue color record has a peak spectral sensitivity of between about 440 and 455 nm.

13. The method of claim 9 wherein color development is carried out at a temperature of from about 35° to about 60° C.

14. The method of claim 13 wherein color development is carried out at a temperature of from about 40° to about 60° C.

* * * * *